US008016902B2

(12) United States Patent
Makarov

(10) Patent No.: US 8,016,902 B2
(45) Date of Patent: Sep. 13, 2011

(54) CYCLONIC UTILITY VACUUM

(75) Inventor: Sergey V. Makarov, Solon, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 125 days.

(21) Appl. No.: 12/121,060

(22) Filed: May 15, 2008

(65) Prior Publication Data

US 2008/0282894 A1 Nov. 20, 2008

Related U.S. Application Data

(60) Provisional application No. 60/930,266, filed on May 15, 2007, provisional application No. 60/932,298, filed on Jul. 26, 2007.

(51) Int. Cl.
*B01D 50/00* (2006.01)

(52) U.S. Cl. ..... 55/337; 55/343; 55/345; 55/346; 55/424; 55/426; 55/428; 55/429; 55/DIG. 3; 15/352; 15/353

(58) Field of Classification Search ..... 55/343, 55/345, 346, 424, 426, 428, 429, DIG. 3, 55/422; 15/353, 352
See application file for complete search history.

(56) References Cited

U.S. PATENT DOCUMENTS

| | | | | |
|---|---|---|---|---|
| 3,465,950 | A * | 9/1969 | Duffy et al. | 55/306 |
| 3,733,814 | A * | 5/1973 | Hull et al. | 60/39.92 |
| 3,870,486 | A | 3/1975 | Eriksson et al. | |
| 3,877,902 | A | 4/1975 | Eriksson et al. | |
| 4,251,241 | A * | 2/1981 | Bothun | 96/317 |
| 5,388,301 | A | 2/1995 | Bosyj et al. | |
| 5,455,983 | A | 10/1995 | Crouser et al. | |
| 5,608,945 | A | 3/1997 | Crouser et al. | |
| 5,644,815 | A | 7/1997 | Bosyj et al. | |
| 5,815,881 | A | 10/1998 | Sjogreen | |
| 5,922,093 | A | 7/1999 | James et al. | |
| 5,943,732 | A | 8/1999 | Bosyj et al. | |
| 6,090,174 | A | 7/2000 | Douma et al. | |
| 6,494,929 | B2 | 12/2002 | Wilkins | |
| 6,758,874 | B1 | 7/2004 | Hunter, Jr. | |
| 7,655,058 | B2 * | 2/2010 | Smith | 55/349 |

(Continued)

FOREIGN PATENT DOCUMENTS

EP 1 535 560 A2 6/2005

(Continued)

OTHER PUBLICATIONS

Machined Translation of KR1020060101067; Sep. 2006; Seong-Geun Kim; 17 pages.*

(Continued)

*Primary Examiner* — Jason M Greene
*Assistant Examiner* — Dung Bui
(74) *Attorney, Agent, or Firm* — Michael Best & Friedrich LLP

(57) ABSTRACT

A vacuum cleaner including multiple cleaning stages comprises a first cyclonic stage and a second cyclonic stage, which is spaced from the first cyclonic stage. A housing defines a first particle collector that communicates with the first cyclonic stage. The first particle collector includes an opening. A removable lid covers the first particle collector opening. A second particle collector in communication with the second cyclonic stage is removable with the lid. A suction motor is supported by the vacuum cleaner. The suction motor establishes and maintains a flow of air through the vacuum cleaner.

20 Claims, 14 Drawing Sheets

U.S. PATENT DOCUMENTS

| | | | | |
|---|---|---|---|---|
| 7,779,505 | B2 * | 8/2010 | Krebs et al. | 15/339 |
| 2005/0028675 | A1 * | 2/2005 | Conrad et al. | 96/57 |
| 2005/0132529 | A1 | 6/2005 | Davidshofer | |
| 2006/0130447 | A1 * | 6/2006 | Seo et al. | 55/426 |
| 2006/0137310 | A1 * | 6/2006 | Conrad et al. | 55/345 |
| 2006/0137314 | A1 * | 6/2006 | Conrad et al. | 55/426 |
| 2006/0162299 | A1 * | 7/2006 | North | 55/345 |
| 2007/0067945 | A1 | 3/2007 | Kasper et al. | |
| 2007/0144117 | A1 * | 6/2007 | Park et al. | 55/345 |
| 2007/0175189 | A1 * | 8/2007 | Gomiciaga-Pereda et al. | 55/459.4 |
| 2007/0209519 | A1 * | 9/2007 | Conrad | 96/414 |
| 2007/0234687 | A1 * | 10/2007 | Ni | 55/337 |
| 2008/0115309 | A1 * | 5/2008 | Pan et al. | 15/300.1 |
| 2008/0134462 | A1 * | 6/2008 | Jansen et al. | 15/347 |
| 2009/0265883 | A1 * | 10/2009 | Reed et al. | 15/353 |

FOREIGN PATENT DOCUMENTS

| | | |
|---|---|---|
| JP | 2005-211350 A | 8/2005 |
| KR | 2 006-0101082 | 9/2006 |
| KR | 2006-0101066 | 9/2006 |
| KR | 2006-0101067 | 9/2006 |
| KR | 1020060101082 | 9/2006 |

OTHER PUBLICATIONS

International Search Report and Written Opinion for International Application No. PCT/US08/63676, dated Aug. 7, 2008, 7 pages.

* cited by examiner

CYCLONIC UTILITY VACUUM

CROSS REFERENCE TO RELATED APPLICATIONS

This application claims priority from U.S. Provisional Patent Application Ser. No. 60/930,266 filed May 15, 2007; and U.S. Provisional Patent Application Ser. No. 60/932,298 filed Jul. 26, 2007. Each provisional patent application is expressly incorporated herein by reference, in its entirety.

BACKGROUND

The present disclosure relates to vacuum cleaners. More particularly, the present disclosure relates to a cyclonic utility vacuum cleaner used for suctioning dirt, dry and wet debris and liquid from various floor surfaces, such as in a wet/dry room, workshop, garage or other like area. However, it should be appreciated that the disclosed utility vacuum cleaner can also be used in a dwelling on tiled, carpeted, wood or linoleum covered floor surfaces.

It is relatively commonplace to find two types of vacuum cleaners in modern households: one that is suited for vacuuming floors and carpets, such as an upright vacuum cleaner or a canister-type vacuum cleaner, and another for relatively heavy-duty cleaning tasks, such as a utility vacuum cleaner.

Utility vacuum cleaners, also known as wet/dry vacuums, are commonly employed in the basements, garages and/or workshops for relatively heavy-duty cleaning tasks. Typical prior art utility vacuum cleaners have a sizeable holding receptacle or tank and an electric motor and fan assembly mounted along its top. In many such units, a cylindrical, pleated disposable filter is fitted onto a perforated cylindrical tube, which is an air intake of a motor housing. A nozzle, connected by a hose to the receptacle serves to draw materials into the receptacle. However, after vacuuming under harsh conditions, the filter can become quickly obstructed by debris or the like. This reduces air flow and impedes the effectiveness of the wet/dry vacuum cleaner, necessitating frequent manual cleaning of the surface of the filter, or its replacement with a new one.

Accordingly, the present disclosure pertains to a new and improved wet/dry vacuum cleaner having a dual stage cyclonic air flow design which overcomes certain difficulties with the prior art designs while providing better and more advantageous overall results.

BRIEF DESCRIPTION

In accordance with one aspect of the present disclosure, a vacuum cleaner including multiple cleaning stages comprises a first cyclonic stage and a second cyclonic stage, which is spaced from the first cyclonic stage. A housing defines a first particle collector that communicates with the first cyclonic stage. The first particle collector includes an opening. A removable lid covers the first particle collector opening. A second particle collector in communication with the second cyclonic stage is removable with the lid. A suction motor is supported by the vacuum cleaner. The suction motor establishes and maintains a flow of air through the vacuum cleaner.

In accordance with another aspect of the present disclosure, a dual stage cyclonic utility vacuum cleaner comprises a first particle collector for collecting separated contaminants therein. The first particle collector includes an upper opening. A removable lid covers the first particle collector opening. A cyclone assembly is mounted to the lid. The cyclone assembly includes a first, upstream, cyclone stage in communication with the first particle collector and a second, downstream, cyclone stage. A second particle collector is in communication with the second cyclone stage. The cyclone assembly is removable from the first particle collector with the lid. A suction motor is supported by the utility vacuum cleaner. The suction motor establishes and maintains a flow of air through the utility vacuum cleaner.

In accordance with yet another aspect of the present disclosure, a multi-stage cyclonic utility vacuum cleaner comprises a liquid containing tank including a drain opening. A cleaner body is supported by the liquid tank. The cleaner body includes a first, upstream, cyclonic separator stage for separating dust from dust-laden air, and a second, downstream, cyclonic separator stage. The second stage includes a plurality of downstream cyclonic separators for separating remaining dust particles from air which has been partially cleaned by the first separator stage. A suction motor is supported by the liquid tank for establishing and maintaining a flow of air through the utility vacuum cleaner. A first inlet conduit is in communication with the liquid tank. A second inlet conduit is in communication with the cleaner body. An outlet conduit has an inlet end in communication with the liquid tank and an outlet end in communication with one of the cleaner body and the suction motor.

In accordance with yet another aspect of the present disclosure, a vacuum cleaner including multiple cleaning stages comprises a housing defining a particle collector. The particle collector includes an opening. A removable lid covers the particle collector opening. The removable lid includes an external wall. A cyclonic stage communicates with the particle collector. The external wall of the removable lid at least partially defines the cyclonic stage. A suction motor is supported by the housing. The suction motor establishes and maintains a flow of air through the vacuum cleaner.

Still other aspects of the disclosure will become apparent from a reading and understanding of the detailed description hereinbelow.

BRIEF DESCRIPTION OF THE DRAWINGS

The present disclosure may take physical form in certain parts and arrangements of parts, several embodiments of which will be described in detail in this specification and illustrated in the accompanying drawings which form a part of the disclosure.

DETAILED DESCRIPTION OF THE INVENTION

It should, of course, be understood that the description and drawings herein are merely illustrative and that various modifications and changes can be made in the structures disclosed without departing from the instant disclosure. Like numerals refer to like parts throughout the several views. It will also be appreciated that the various identified components of the utility vacuum cleaner disclosed herein are merely terms of art that may vary from one manufacturer to another and should not be deemed to limit the present disclosure.

Figure 1:
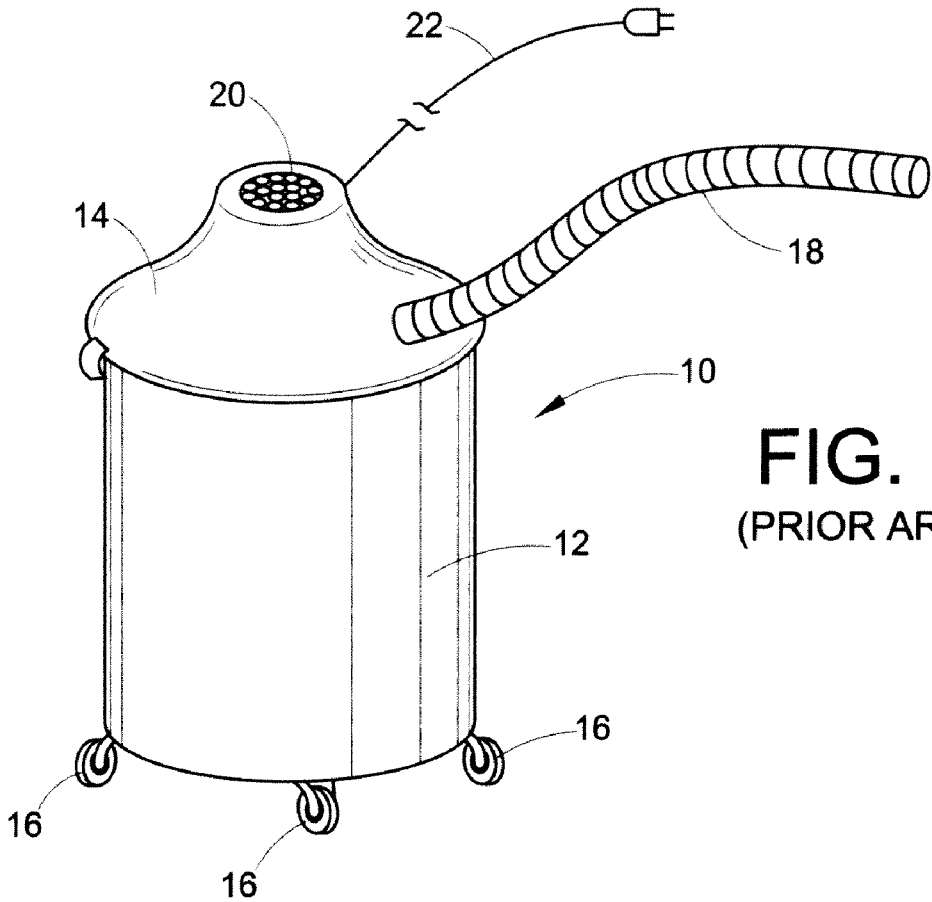
FIG. 1 (PRIOR ART)
FIG. 1 is a perspective view of a prior art utility vacuum cleaner.
Figure 2:
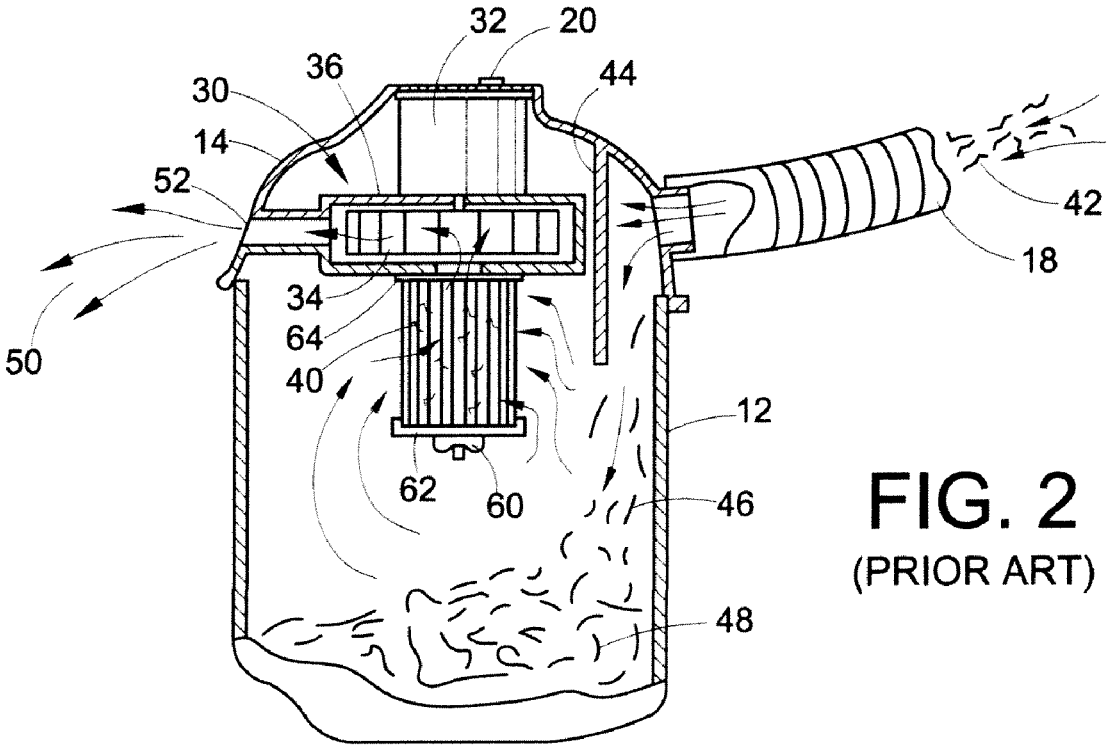
FIG. 2 (PRIOR ART)
FIG. 2 is a partial cross-sectional view of the prior art utility vacuum cleaner of FIG. 1.

FIGS. 1 and 2 illustrate a prior art utility vacuum cleaner 10. The cleaner generally includes a debris collection tank 12, a removable lid 14 mounted to an upper portion of the tank, casters 16 connected to a lower portion of the tank for allowing the vacuum cleaner to move across a subjacent surface, an inlet vacuum hose 18, a power switch 20, and a power cord with a plug 22. An electric motor and fan assembly 30 is mounted to the lid 14. The electric motor and fan assembly includes a motor 32 and an impeller 34 operably disposed within an impeller housing 36. The electric motor and fan assembly creates a vacuum, which pulls air through a cylindrical pleated disposable filter 40 into a bottom center of the impeller housing. As debris laden air 42 is pulled through the inlet vacuum hose 18, it engages an impingement barrier 44, whereby dense debris is separated from the air flow and drops down as at 46, into a debris pile 48 located at the bottom of the collection tank 12. The partially cleaned air enters the filter 40 which entraps most of the remaining dirt particles. The cleaned air 50 emerges from an outlet 52.

As indicated previously, in the course of operation, dirt particles accumulate on the outer surface of filter 40. This reduces air flow and impedes the effectiveness of the utility vacuum cleaner, necessitating frequent manual cleaning of the surface of the filter or its replacement with a new one. The filter can be replaced by unscrewing a wing nut 60, removing a cover 62 and then sliding off the soiled filter from a filter housing 64. A new filter is then installed in its place.

Figure 3:
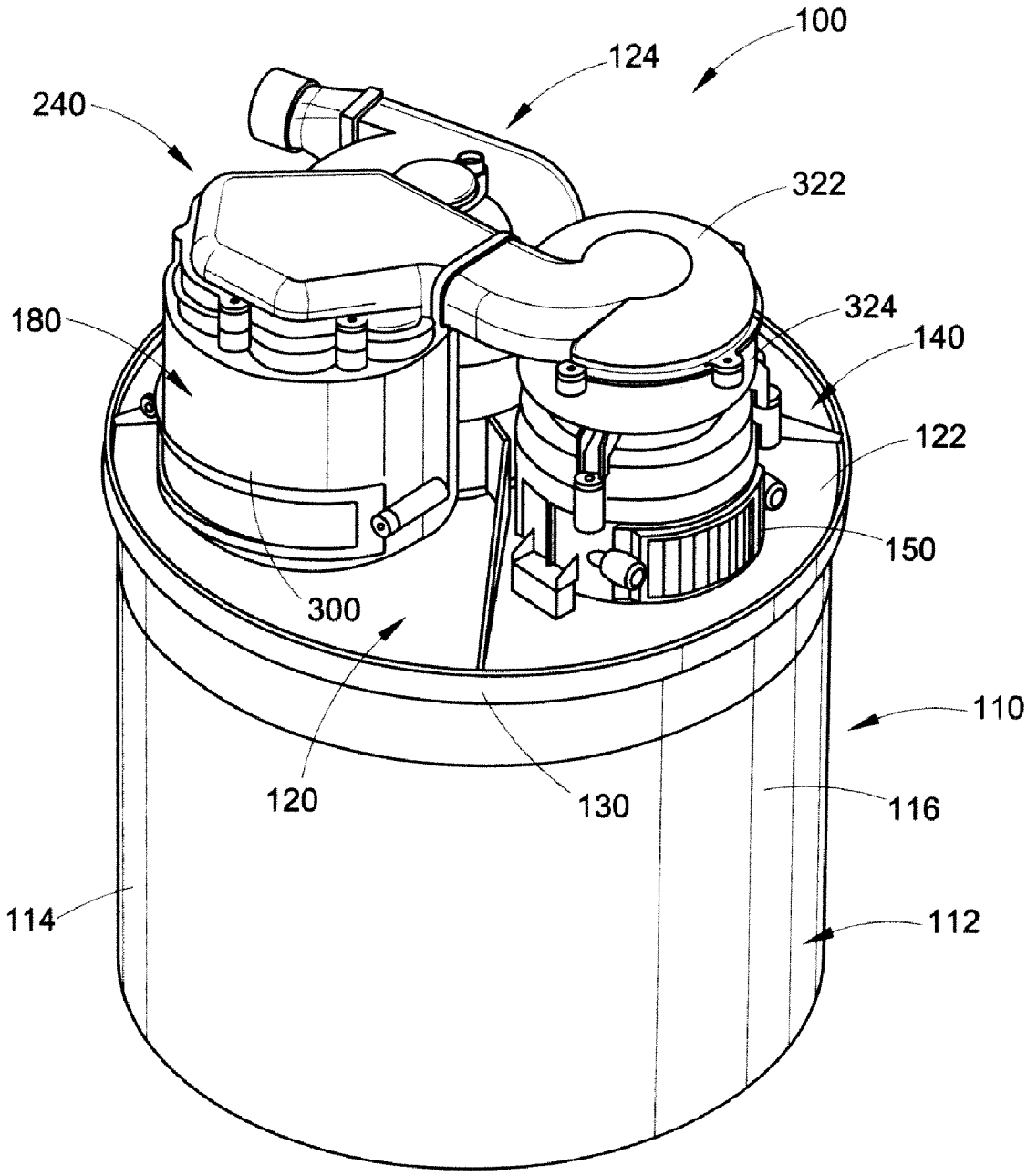
FIG. 3 is rear perspective view of a utility vacuum cleaner according to one aspect of the present disclosure.
Figure 4:
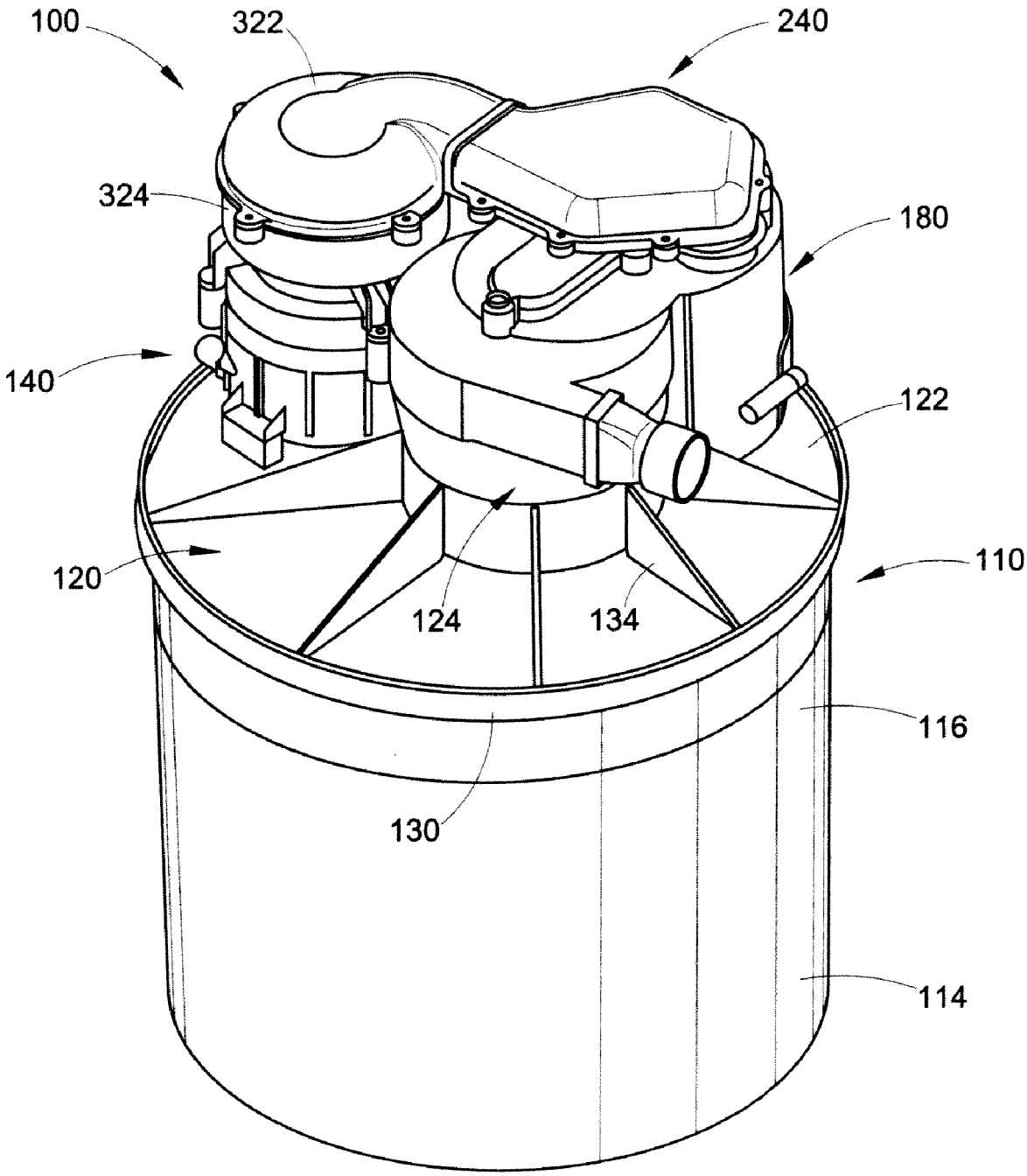
FIG. 4 is front perspective view of the utility vacuum cleaner of FIG. 3.

Referring now to the present disclosure, wherein the drawings show an embodiment only and are not intended to limit same, FIGS. 3 and 4 illustrate a dual stage cyclonic utility vacuum cleaner 100. The cleaner 100 comprises a cleaner body 110 and a housing defining a first particle collector, receptacle or tank 112 for collecting separated contaminants therein. A lower portion 114 of the tank can be mounted to a base (not shown) provided with a plurality of casters (not shown) on a lower surface thereof for enabling easy movement of the cleaner 100 across a subjacent surface. Alternatively, a plurality of casters can be directed mounted to the lower portion of the tank. An upper portion 116 of the tank 112 includes an opening 118 which is covered by a removable lid 122. The lid can be secured to the tank via any conventional manners, such as one or more over center latches, or the like.

Figure 7:
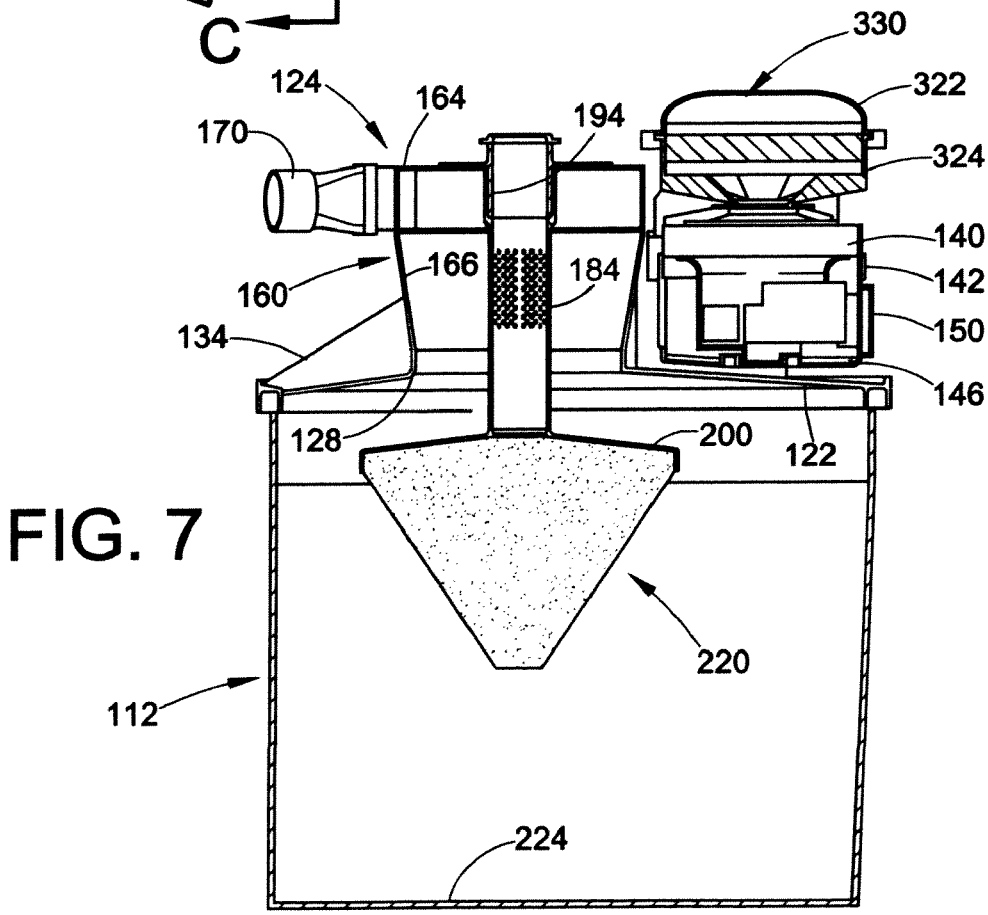
FIG. 7 is a cross-sectional view of the utility vacuum cleaner of FIG. 3 taken generally along the line A-A of FIG. 6.

To avoid the problems associated with a conventional pleated filter for a utility vacuum (e.g., a reduction in air flow caused by the pleated filter becoming quickly obstructed by debris after vacuuming under harsh conditions), a cyclone assembly 120 is mounted to the lid 122 for separating dust from dust-laden air. The cyclone assembly comprises a first filtration stage or cyclone part 124 positioned atop the lid, over a lid opening 128 (FIG. 7). The lid has an external wall 126 and a downwardly extending flange or skirt 130 which is dimensioned to fit over an outer surface of the upper portion 116 of the tank 112. The external wall at least partially defines the first cyclone part 124 such that the cyclone assembly 120 can form at least a portion of an exterior surface of the cleaner 100. Although, this is not required. At least one reinforcing member or gusset 134 can be provided to add further strength and stability to the first cyclone assembly 120. Particularly, in the depicted embodiment, a plurality of spaced apart reinforcing members 134 extend between the lid 122 and the first cyclone part 124. This provides additional stability against vertical deflecting forces and maintains the generally perpendicular relationship between the lid and first cyclone part. The lid can be made from a suitable conventional material, such as a plastic or a metal.

Figure 5:
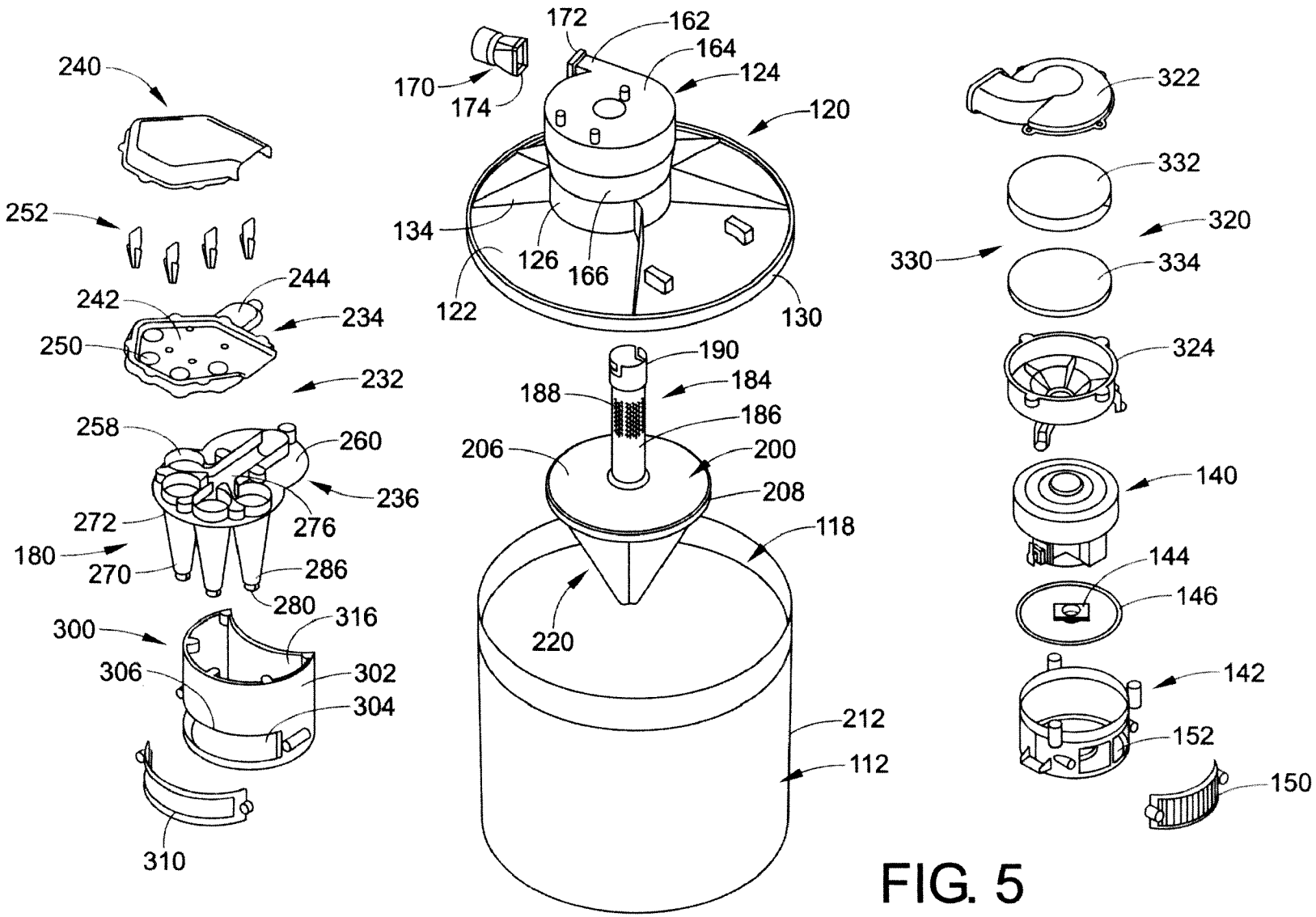
FIG. 5 is an exploded perspective view of the utility vacuum cleaner of FIG. 3.
Figure 6:
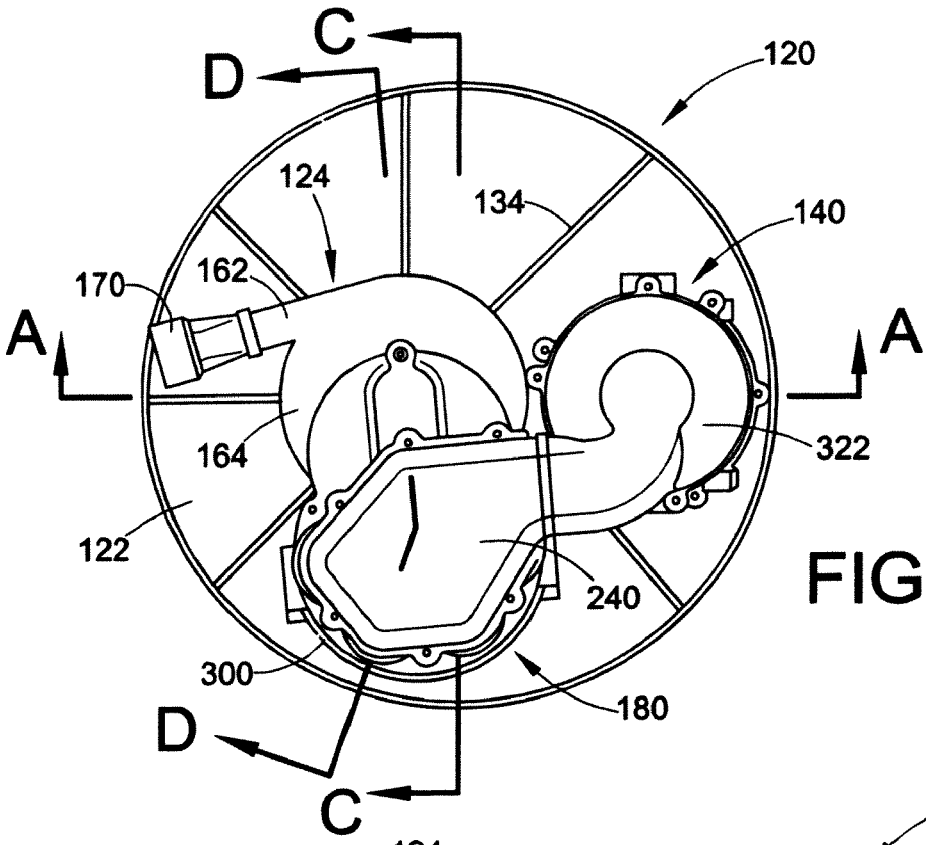
FIG. 6 is a top view of the utility vacuum cleaner of FIG. 3.

With reference to FIGS. 3 and 5, a suction motor 140, which is supported by the liquid tank, generates the required suction airflow for cleaning operations by creating a suction force in a suction inlet and an exhaust force in an exhaust outlet and maintains flow of air through the utility vacuum. The suction motor is housed in a motor housing 142 releasably secured to and removable with the lid 122, adjacent the first cyclone part 124. The suction motor is mounted on a motor mount 144. A gasket 146, in an assembled position, seals off a lower portion of the motor housing. The suction motor 140 has an exhaust outlet which is in fluid communication with an exhaust grill 150, covering an exhaust opening 152 located on a wall of the motor housing 142. If desired, a final filter assembly can be provided for filtering the exhaust air stream of any contaminants which may have been picked up in the suction motor immediately prior to its discharge into the atmosphere. The suction motor inlet, on the other hand, is in fluid communication with the cleaner body 112 to generate a suction force therein. A cord-reel device (not shown) can be mounted to the cleaner body 110. Cord-reel can be either spring loaded or hand-operated.

Figure 8:
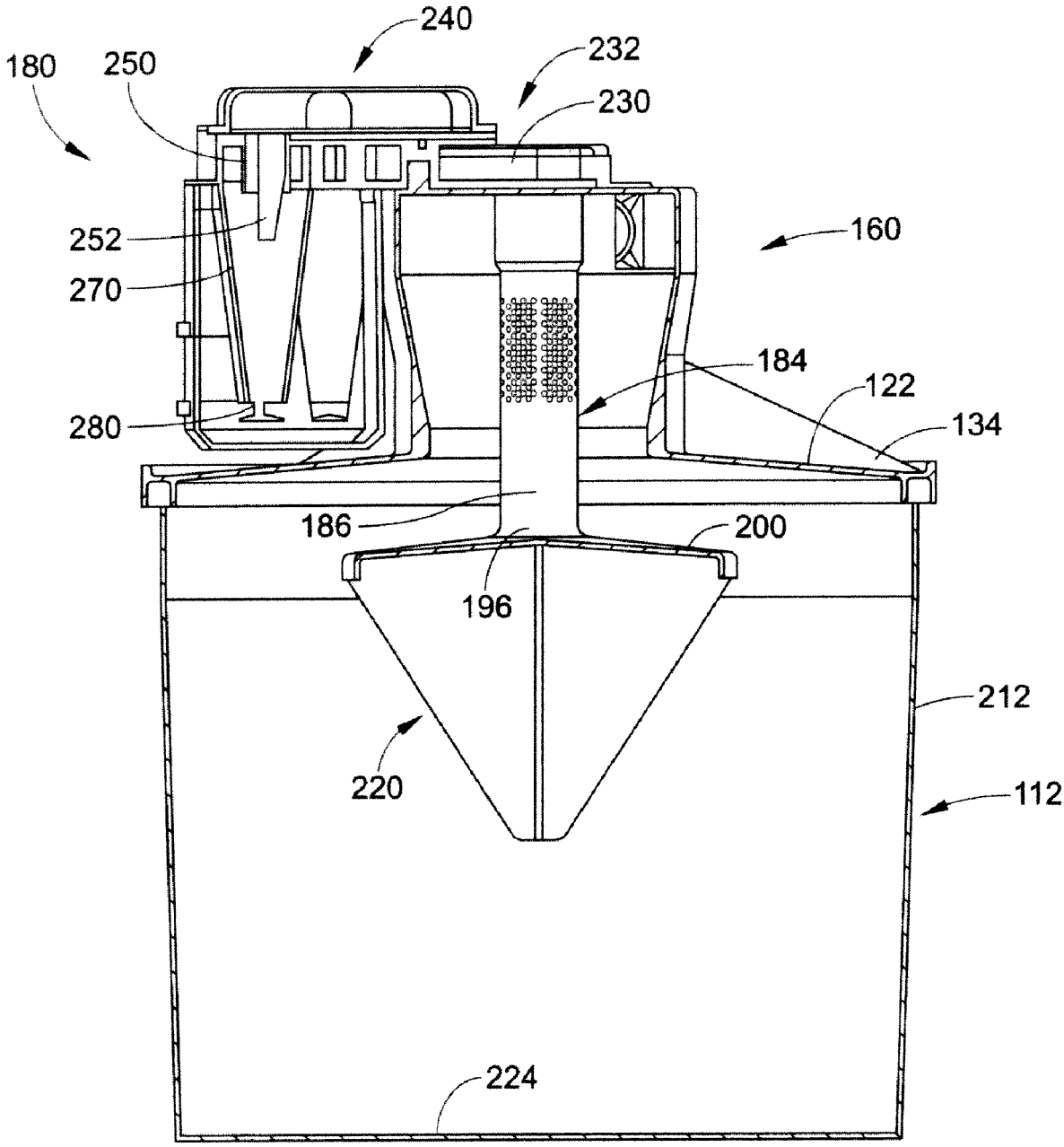
FIG. 8 is a cross-sectional view of the utility vacuum cleaner of FIG. 3 taken generally along the line C-C of FIG. 6.
Figure 9:
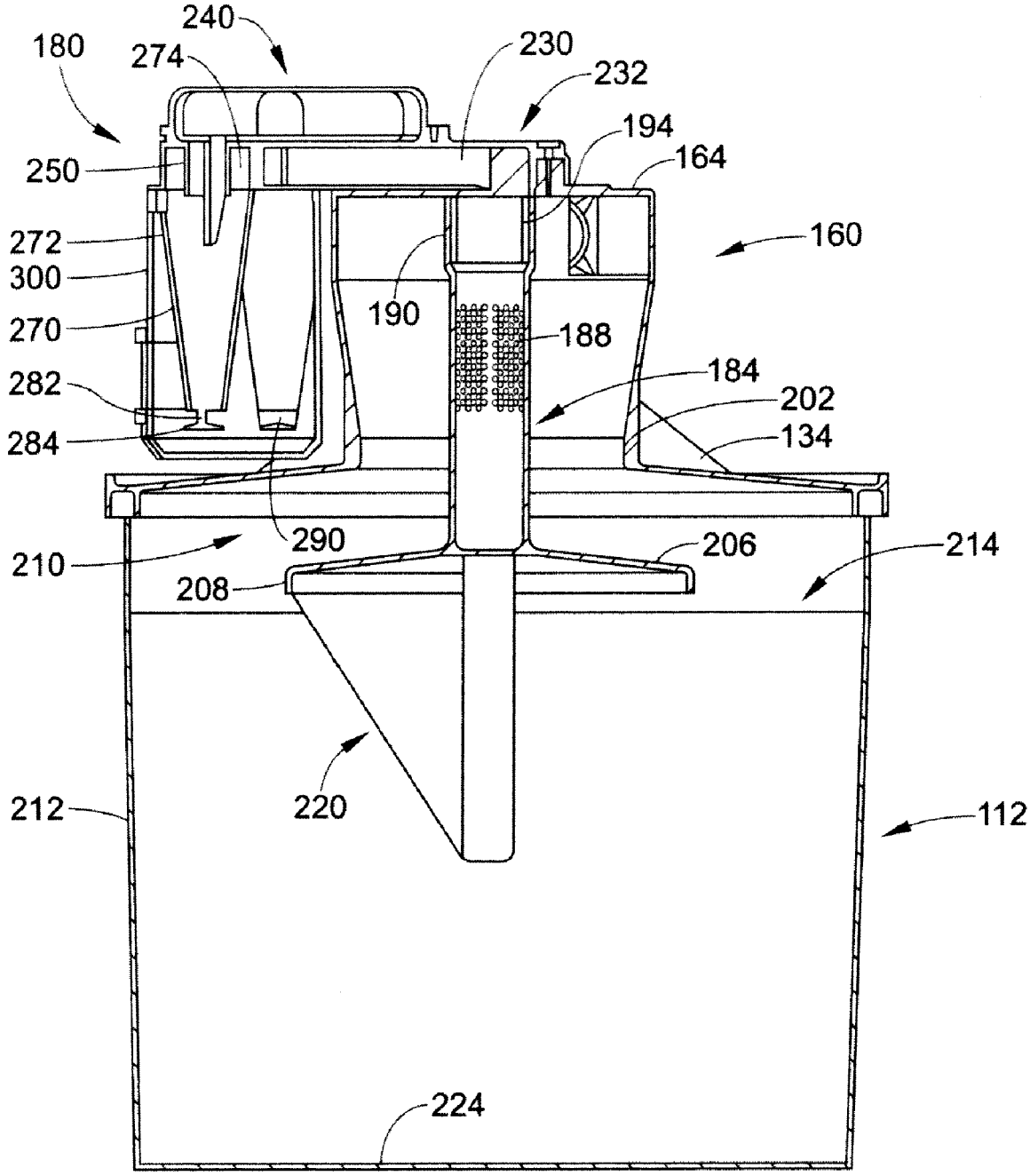
FIG. 9 is a cross-sectional view of the utility vacuum cleaner of FIG. 3 taken generally along the line D-D of FIG. 6.

As shown in FIGS. 7-9, the first cyclone part 124 can comprise a generally frusto-conical shaped first stage cyclone separator 160. The first stage separator includes a dirty air inlet conduit 162, a top wall 164 and a sidewall 166 having an outer surface and an inner surface. At least a portion of the first cyclone part is mounted to the removable lid, which allows the first cyclone part to be easily serviced. In the depicted embodiment, the external wall 126 of the lid 122 defines the first cyclone part, specifically at least a portion of the sidewall 166 of the first stage separator; although, this is not required. This can reduce the weight and manufacturing costs of the cleaner body.

The inlet conduit 162 is in fluid communication with a duct 170, which is connected to a suction hose and nozzle (not shown) for suctioning dirt, debris and other contaminants from a surface to be cleaned. The dirty air inlet conduit 162 of the separator 160 can be generally rectangular in cross-section. It should be appreciated that at least one of the duct and conduit can have a varying dimension which allows the air stream to be drawn into the first stage separator 160 by way of the venturi effect, which increases the velocity of the air stream and creates an increased vacuum in the separator.

The airflow into the first stage separator 160 is tangential which causes a vortex-type, cyclonic or swirling flow. Such vortex flow is directed downwardly in the first stage separator by the top wall 164. Cyclonic action in the first stage separator 160 removes a substantial portion of the entrained dust and dirt from the suction air stream and causes the dust and dirt to be deposited in the lower portion 114 of the tank 112.

With continued reference to FIGS. 8 and 9, fluidly connecting the first cyclone part 124 to a second filtration stage or cyclone part 180 of the cyclone assembly is a perforated tube 184. The perforated tube can supported by the lid 122 and removably disposed within the first stage separator 160 and extends longitudinally from the top wall 164 of the separator along a longitudinal axis of the first stage separator. In the present embodiment, the perforated tube 184 has a longitudinal axis coincident with the longitudinal axis of the first stage separator 160 and offset from a longitudinal axis of the tank. The perforated tube 184 includes a generally cylindrical section 186. A plurality of openings or perforations 188 is located around a portion of the circumference of the cylindrical section. The openings are useful for removing threads and fibers from the air stream which flows into the perforated tube.

As might be expected, the diameter of the openings 188 and the number of those openings within the perforated tube 184 directly affect the filtration process occurring within the tank. Also, additional openings result in a larger total opening area and thus the airflow rate through each opening is reduced. Thus, there is a smaller pressure drop and lighter dust and dirt particles will not be as likely to block the openings. The openings 188 serve as an outlet from the first stage separator 160, allowing the partially cleaned fluid to enter the second cyclone part 180. It should be appreciated that the cylindrical section 186 can have a varying dimension which allows the air stream to be drawn into the perforated tube 184 by way of the venturi effect, which increases the velocity of the air stream flowing through the perforated tube and creates an increased vacuum in the openings 188. For example, the cylindrical section can include a decreasing cross-sectional area.

An upper end 190 of the perforated tube can be releasably mounted to a mouth 194 extending downwardly from the top wall 164 of the first stage separator 160. In particular, the upper end of the perforated tube has an inner diameter greater than an outer diameter of the mouth such that the mouth is received in the upper end. These two elements can be secured together by the illustrated slotted openings, adhesives, frictional welding or the like. It can be appreciated that the perforated tube can be made removable from the first cyclone part 124 for cleaning purposes.

Connected to a lower, closed end 196 of the perforated tube 184 is a shroud 200 for retarding an upward flow of dirt and dust particles that have fallen below a lower end 202 of the first stage separator 160. The shroud has an outwardly flared section 206 and a flange 208 extending downwardly from the flared section. As is best illustrated in FIGS. 7-9, a diameter of the shroud, particularly an end of the outwardly flared section, is larger than a diameter of the separator lower end 202 and an inside diameter of the tank 112 is substantially larger than the diameter of the separator lower end. This prevents dust from being picked up by flow of air streaming from the tank 112 toward the openings 188 of the perforated tube 184. The flared section 206 of the shroud 200, which is generally parallel to the lid 122, and the lid define a first air channel 210. The shroud flange 208, which is generally parallel to a side wall 212 of the tank 112, and the tank side wall define a second air channel 214. The first and second air channels direct air from the first stage separator 160 into the tank. The first air channel and the second air channel can have a substantially constant volume for maintaining airflow velocity. Also, the volume of the first air channel can be approximately equal to the volume of the second air channel.

A laminar flow member, such as one or more baffles or fins 220, can be mounted to the closed lower end 196 of the perforated tube 184. At least a portion of the laminar flow member is encircled by the shroud 200. The laminar flow member extends generally along a longitudinal axis of the perforated tube and partially into the tank 112. As shown in FIGS. 8 and 9, the depicted baffle 220 can be cruciform in shape and include a cross blade assembly, which can be formed of two flat blade pieces that are oriented approximately perpendicular to each other. It should be appreciated that the baffles 220 are not limited to the configuration shown in FIGS. 8 and 9 but may be formed of various shapes. For example, if a blade is employed, it can have a rectangular shape, a triangular shape or an elliptical shape, when viewed from its side. Also, in addition to a cross blade design, other designs are also contemplated. Such designs can include blades that are oriented at angles other than normal to each other or that use more than two sets of blades. These baffles can assist in allowing dirt and dust particles to fall out of the air stream between the perforated tube lower end 196 and a bottom wall 224 of the tank 112.

With reference again to FIGS. 3, 8 and 9, the upper end or air outlet 190 of the perforated tube 184 is in fluid communication with an air inlet section 230 of an air manifold 232 disposed outside the tank 112 and positioned above the first stage separator 160. The air manifold includes a top guide plate 234 and a bottom guide plate 236. The guide plates direct partially cleaned air flowing from the tank 112 and through the perforated tube 184 towards the second cyclone part 180.

The top guide plate 234 can be provided under a cover unit 240 and includes a wall 242. The cover unit can be hinged to provide access to the second cyclone part 180 for cleaning. Extending outwardly from the wall 242 is a generally arcuate flange 244, which forms a portion of the manifold air inlet section 230. Located on the wall 242 is a plurality of discharge guide tubes 250. As shown in FIGS. 8 and 9, each discharge guide tube 250 has a generally cylindrical shape and projects downward from the top guide plate 234. The discharge guide tubes direct the cleaned air exhausted from the second cyclone part 180 into the cover unit 240. Each discharge guide tube can include a laminar flow member to stop the air from circulating within the discharge tube. As shown in FIG. 3, the laminar flow member can be a generally cross-shaped baffle 252. However, it should be appreciated that other shapes are also contemplated. A portion of the baffle projects a predetermined distance from a lowermost end of each discharge guide tube into the interior of the second cyclone part 180. The cross-sectional area of the baffle at any point along its length is generally cross-shaped.

The bottom guide plate 236 is spaced from the top guide plate 234 by a generally continuous, peripheral barrier 258 extending upwardly from a wall 260. The barrier abuts against a bottom surface of wall 242 and flange 244 to define an air passage from the manifold air inlet section 230 to the second cyclone part 180.

With reference again to FIGS. 5, 8 and 9, at least a portion of the second cyclone part is mounted to the lid. In the depicted embodiment, the second cyclone part 180 can be supported by and removable with the lid 122. This allows the second cyclone part to be easily serviced. The second cyclone part comprises a plurality of spaced apart, frusto-conical, downstream, second stage cyclonic separators 270. The downstream separators 270 can be arranged in parallel and can be mounted on the air manifold 232 radially outside of the first cyclone part 124. In the depicted embodiment, and as shown in FIG. 9, the downstream separators 270 project downwardly from the wall 260 of the bottom guide plate 236 such that uppermost end 272 of each downstream separator is located approximately in the same plane as defined by the top wall 164 of the first stage separator 160. Each downstream separator 270 includes a dirty air inlet 274 in fluid communication with one of an isolated air conduit 276 defined by the guide plate 234 and the barrier 258 of guide plate 236, which at least partially surround the dirty air inlet 274 of each downstream separator 270. Each manifold air conduit 276 directs a volume of partially cleaned air generally tangentially into the inlet 274 of each second stage separator 270. This causes a vortex-type, cyclonic or swirling flow. Such vortex flow is directed downwardly in the downstream separator since a top end thereof is blocked by the bottom surface of wall 260. Each second stage or downstream separator 270 can have a dimensional relationship such that a diameter of its upper end is three times the diameter of its lower end. This relationship is seen to improve the efficiency of cyclonic separation.

With reference again to FIGS. 8 and 9, each downstream separator 270 includes a dust blocking member 280 having a connection member 282 and a dust blocking plate 284. The connecting member is mounted to a lower end 286 of each downstream separator 270. In this embodiment, an upper portion of the connecting member is integrally formed with the separator lower end; although, this is not required. The dust blocking plate 284 is attached to a lower portion of the connecting member so as to be spaced from a particle outlet 290 of each downstream separator by a predetermined distance. Dust blocking plate deflects the dust and also prevents dust discharged from cyclones from reentering the cyclones. A second, separate particle collector or dust collection container 300, which in this embodiment, is removably attached to the bottom guide plate 236 and prevents re-entrapment of dirt that has fallen into the dust collection container into the cleaned air exiting each downstream separator. The lower end 286 of each second stage separator 270 and a bottom surface of the dust blocking plate 284 can be inclined at an acute angle of approximately fifteen degrees (15°) relative to a longitudinal axis of each separator. This configuration allows dirt to easily pass downwardly through the particle outlet 290 and into the dust collection container 300 reducing risk of dirt collecting in the area of the particle outlet and causing a blockage.

As stated above, the dirt separated by each downstream separator 270 is collected in the separate dust collection container 300, which in this embodiment, is positioned above the tank lid 122 and removable with the tank lid. Thus, the tank 112 and the dust collection container 300 are completely separated from each other such that the airflow in one does not affect the airflow in the other. This further improves the dust collection efficiency of the cleaner body.

With reference to FIG. 3, the dust collection container, which at least partially encases or surrounds the plurality of downstream separators 270, includes a sidewall 302 and a bottom wall 304. The sidewall 302 includes an opening 306 which allows for removal of the dirt particles collected in the container. In the depicted embodiment, an opening cover 310 is removably attached to the sidewall. A portion of the cover can be made of a transparent material so that the presence of dirt can be seen in the dust collection container 300. A seal (not shown) can be fitted around the cover 310 to create a seal between the cover and sidewall 302. A hinge and latch assembly (not shown) can be used to mount the cover to the side wall. It should be appreciated that alternate means for removing dust separated by the downstream separators 270 is contemplated. For example, a drawer (not shown) can be removably received in the opening 306 for collecting separated dust particles. The drawer can include a handle or like means for allowing a user to grip the drawer and remove the drawer from the dust collection container 300 so that dust collected therein can be emptied. A conventional latch assembly can be used to maintain the drawer in a closed position. A portion 316 of the sidewall diametrically opposed from the sidewall opening 306 is curved toward the dust collection container 300 such that the dust collection chamber can mate with the wall 166 of the first stage separator 160.

As indicated previously, each of the discharge guide tubes 250 directs the cleaned air exhausted from the second cyclone part 180 into the cover unit 240 before being discharged to a separate filtration stage or filter assembly 320. The filter assembly is located downstream of the second cyclone part 180 and upstream of the suction motor 140. As shown in FIGS. 3 and 7, the filter assembly, which can be supported by and removable with the lid 122, includes a top plenum 322 releasably secured to a bottom plenum 324. The plenums define an enclosure for housing a filter element 330 therein. An inlet of the top plenum is connected to the cover unit 240. The top plenum collects a flow of cleaned air from the downstream separators 270 and directs the cleaned air through the filter element 330 for filtering any remaining fine dust remaining in the airflow exiting the downstream separators. The bottom plenum 324 collects a flow of cleaned air from the filter element 330 and merges the flow of cleaned air into the inlet of the electric motor and fan assembly 140.

In this embodiment, a two stage filter element 330 is disclosed. It can include at least one foam filter. Such foam filter can be a compound member having a coarse foam layer 332 and a fine foam layer 334, at least partially housed in the bottom plenum 324. The two foam layers can, if desired, be secured to each other by conventional means. The two stage filter element 330 can be easily serviced by removing the top plenum from the bottom plenum. For example, the top plenum 322 can be hinged to provide access to the filter element 330 for cleaning. Alternately, or in addition, a pleated filter can be employed.

In operation, dirt entrained air passes into the upstream, first cyclone separator 160 through the dirty air inlet conduit 162 which is oriented tangentially with respect to the sidewall 166 of the separator 160. The air then travels cyclonically around the separation chamber where many of the particles and liquid entrained in the air are caused, by centrifugal force, to travel along the interior surface of the sidewall of the separator 160 and drop out of the rotating air flow by gravity. These particles collect on the bottom wall 224 of the tank 112. However, relatively light, fine dust is less subject to a centrifugal force. Accordingly, fine dust may be contained in the airflow circulating near the bottom portion of the tank 112. Since the cross blade 220 extends into the bottom portion of the tank 112, the circulating airflow hits the blade assembly and further rotation is stopped, thereby forming a laminar flow. In addition, if desired, extending inwardly from a bottom portion of the tank wall 212 can be laminar flow members (not visible) which further prevent the rotation of air in the bottom of the tank. As a result, a substantial portion of the fine dust entrained in the air is also allowed to drop out.

The partially cleaned air travels through the openings 188 of the perforated tube 184. The partially cleaned air then travels through the air manifold 232 mounted above the perforated tube and into the frusto-conical downstream cyclonic separators 270 of the second cyclonic stage. There, the air cyclones or spirals down the inner surfaces of the several cyclonic separators to separate out the remaining fine dirt. The now twice cleaned air flows upward through the discharge guide tubes 250 and into the cover unit 240. The baffles 252 cause the air flowing through each discharge guide tube to assume a laminar flow. Fine dirt separated in the downstream cyclonic separators collects in the dust collection container 300. The cleaned air flows out of the cover unit 240 into the top plenum 322, through the two stage filter assembly 330 and into the bottom plenum 324. The bottom plenum is in fluid communication with the air inlet to the electric motor and fan assembly 140. The cleaned air is discharged to the atmosphere through the exhaust grill 150, which covers the exhaust opening 152 located on the motor housing 142.

The tank 112 and the collection container 300 are configured to empty independently of each other. This minimizes the amount of fine dust introduced into ambient air during emptying of the tank and servicing of the vacuum cleaner. Particularly, to empty the dirt collected in the tank 112, the lid 122 is detached from the tank so that the tank can be tilted in order to empty the contents therein. To empty the dirt collected in the collection container 300, the cover 310 is opened so that the container can be emptied, such as by pulling out a drawer (not shown) holding the dirt. To reduce the amount of fine dusk that may be introduced into atmosphere during emptying of the collection container 300, the collection container can include a conventional dust absorbent material. Alternatively, the dirt collected in the container 300 can be transferred into the tank 112 for emptying.

It should be appreciated that the vast majority of the debris or dirt will be separated out in the first cyclonic cleaning stage, and collected in the tank 112. That is the reason why tank 112 is so much larger than the second stage container 300. Also, the tank 112 will likely have to be emptied more frequently than the debris collected in container 300. It has to be noted that second particle collector can be emptied into first particle collector. In this design lid 122 serves as a bottom of second particle collector. A dump door can be utilized to empty second particle collector into first particle collector. Door can be actuated by a button or lever.

Similar to the aforementioned embodiment, a second embodiment of a cyclonic utility vacuum cleaner 500, specifically a wet/dry utility vacuum cleaner, is shown in FIGS. 10-13. Since most of the structure and function is quite similar, reference numerals with a primed suffix (') refer to like components (e.g., cyclone assembly 120 is referred to by reference numeral 120'), and new numerals identify new components in the additional embodiment.

With reference to FIGS. 10-13, the cleaner 500 comprises a housing or liquid tank 512 and a cleaner body 514 at least partially housed within a chamber 520 defined by the liquid tank. The liquid tank 514 can be generally cylindrical in shape; although alternative conformations for the tank are also contemplated. The liquid tank includes a side wall 522, a bottom wall 524 and a top wall 526. The top wall includes a chamber opening 530 dimensioned to at least partially receive the cleaner body 514. A liquid inlet conduit 532 at least partially extends through a first opening 534 located on the tank top wall 526. The conduit includes an inlet section 536 in selective communication with a conventional hose and nozzle assembly (not shown) for suctioning liquid and wet debris from a surface to be cleaned and an outlet section 538 extending into the chamber 520. The liquid tank can be made from a suitable conventional material, such as a plastic or a metal.

Figure 11:
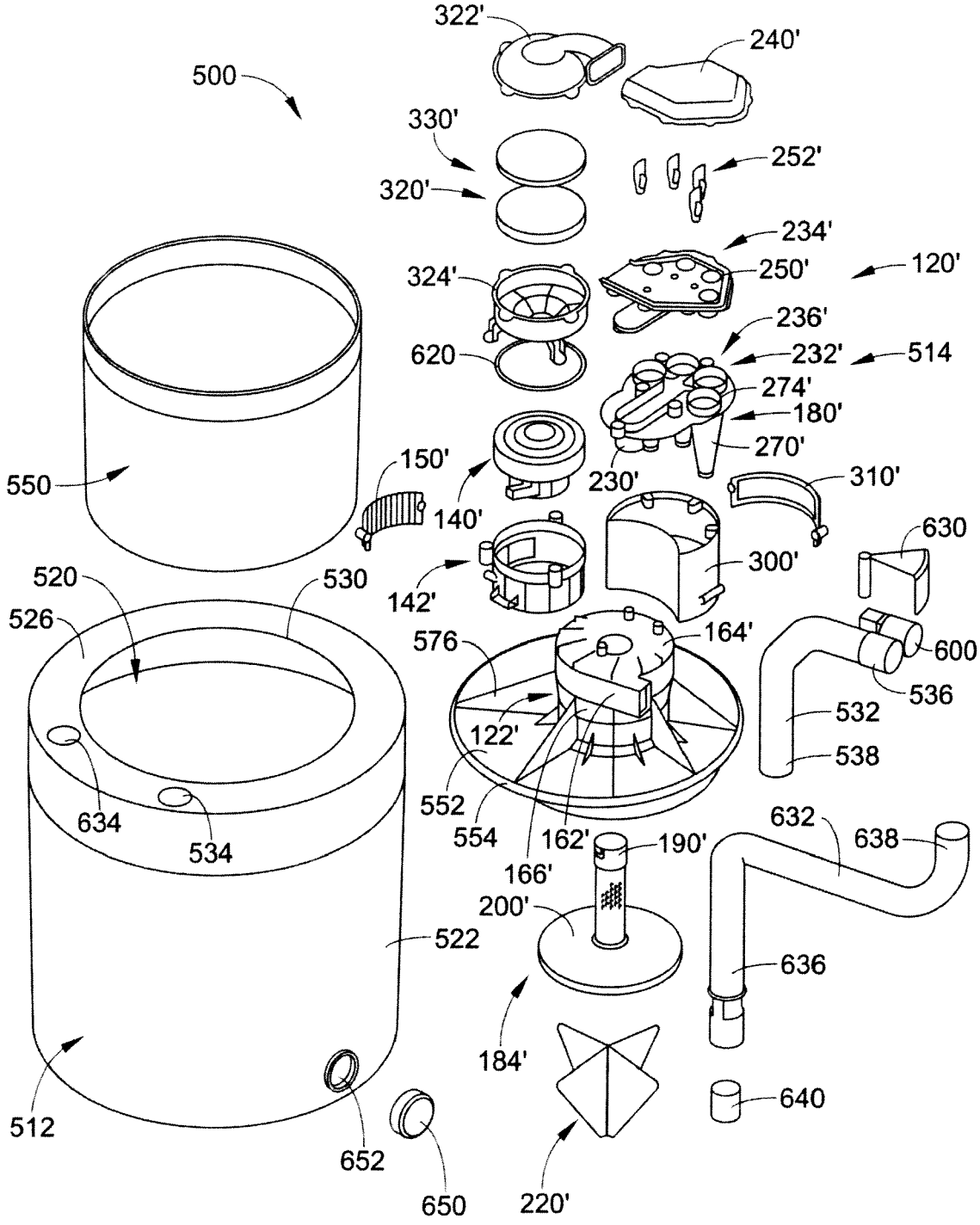
FIG. 11 is an exploded perspective view of the utility vacuum cleaner of FIG. 10.

As shown in FIG. 11, the cleaner body 514 includes a first particle collector, receptacle or tank 550 for collecting separated contaminants therein. In the depicted embodiment, a longitudinal axis of the liquid tank 512 is generally coincident with a longitudinal axis of the receptacle 550; although, this is not required. An open upper portion of the receptacle is covered by a removable lid 552. The lid can be secured to the receptacle via any conventional means, such as one or more over center latches, or the like. The lid has a downwardly extending flange or skirt 554 which is dimensioned to rest on the liquid tank top wall 526. In this position, the receptacle 550 is suspended in an upper portion of the chamber 520. The lid 552 can be secured to the top wall 526 via any conventional manners.

Similar to the previous embodiment, a cyclone assembly 120' is mounted to the lid 552 and comprises a first cyclone part 122' positioned atop the lid, over a lid opening 574. The cyclone assembly is removable from the tank with the lid. An external wall of the lid 552 at least partially defines the first cyclone part. The lid skirt 554 is dimensioned to fit over an upper outer surface of the receptacle 550. At least one reinforcing member or gusset 576 can be provided to add further strength and stability to the cyclone assembly 120'. The lid can be made from a suitable conventional material, such as a plastic or a metal.

Figure 12:
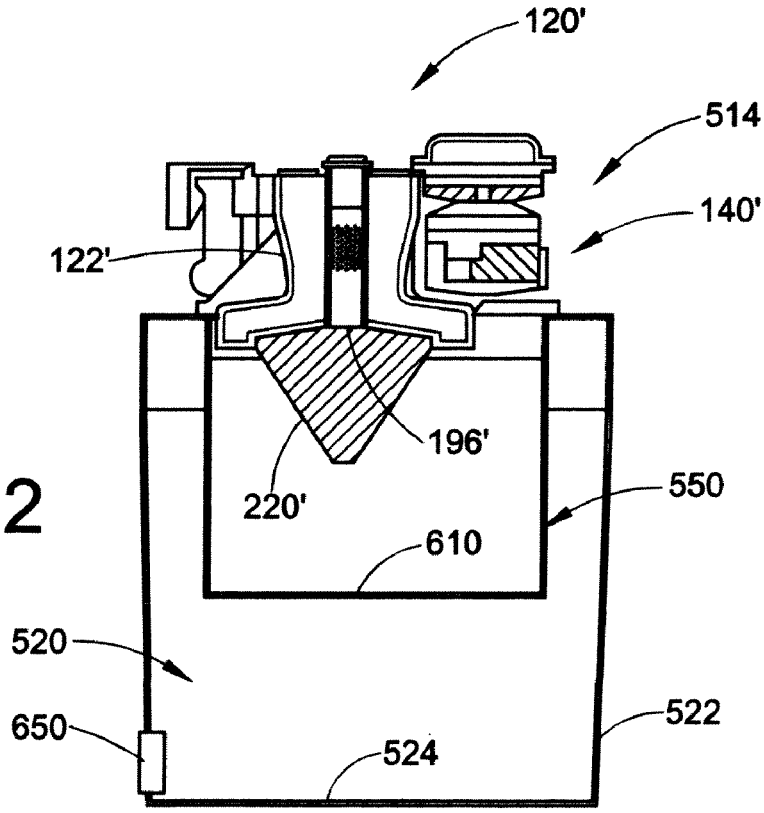
FIG. 12 is a first cross-sectional view of the utility vacuum cleaner of FIG. 10.

With reference to FIGS. 11 and 12, a suction motor 140' is supported by the cleaner 500. The suction motor generates the required suction airflow for cleaning operations by creating a suction force in a suction inlet and an exhaust force in an exhaust outlet. The suction motor is housed in a motor housing 142' releasably secured to and removable with the lid 552, adjacent the first cyclone part 122'. The motor exhaust outlet is in fluid communication with an exhaust grill 150'. The suction motor inlet, on the other hand, is in fluid communication with one of the liquid tank 512 and the cleaner body 514 to generate a suction force therein.

The first cyclone part 122' can comprise a generally frustoconical shaped first stage cyclone separator 160'. The first stage separator includes a dirty air inlet conduit 162', a top wall 164' and a sidewall 166' having an outer surface and an inner surface. The inlet conduit 162' is in fluid communication with a duct 600, which is connected to a suction hose and nozzle (not shown) for suctioning dirt, debris and other contaminants from a surface to be cleaned. The dirty air inlet conduit can, if desired, be generally rectangular in cross-section.

The airflow into the first stage separator 160' is tangential which causes a vortex-type, cyclonic or swirling flow. Such vortex flow is directed downwardly in the first stage separator by the top wall 164'. Cyclonic action in the first stage separator removes a substantial portion of the entrained dust and dirt from the suction air stream and causes the dust and dirt to be deposited in a lower portion of the receptacle 550.

With continued reference to FIGS. 11 and 12, fluidly connecting the first cyclone part 122' to a second cyclone part 180' of the cyclone assembly is a perforated tube 184' for removing threads and fibers from the air stream which flows into the perforated tube. The perforated tube can be removably disposed within the first stage separator 160' and extends longitudinally from the top wall 164' of the separator. The perforated tube serves as an outlet from the first stage separator 160', allowing the partially cleaned fluid to enter the second cyclone part 180'.

Connected to a lower, closed end 196' of the perforated tube 184' is a shroud 200' for retarding an upward flow of dirt and dust particles that have fallen below the first stage separator 160'. A laminar flow member, such as one or more baffles or fins 220', can be mounted to the perforated tube. The laminar flow member extends generally along a longitudinal axis of the perforated tube and partially into the receptacle 550. These baffles can assist in allowing dirt and dust particles to fall out of the air stream between the perforated tube lower end 196' and a bottom wall 610 of the receptacle 550.

With reference again to FIG. 11, an upper end or air outlet 190' of the perforated tube 184' is in fluid communication with an air inlet section 230' of an air manifold 232' positioned above the first stage separator 90. The air manifold includes a top guide plate 234' and a bottom guide plate 236'.

The guide plates direct partially cleaned air flowing from the receptacle 550 and through the perforated tube 184' towards the second cyclone part 180'.

The top guide plate can be provided under a cover unit 240'. The cover unit can be hinged to provide access to the second cyclone part for cleaning. Located on the top guide plate is a plurality of discharge guide tubes 250'. The discharge guide tubes direct the cleaned air exhausted from the second cyclone part 180' into the cover unit 240'. Each discharge guide tube can include a laminar flow member 252' to stop the air from circulating within the discharge tube. The top and bottom guide plates together define an air passage from the manifold air inlet section 230' to the second cyclone part 180'.

Figure 13:
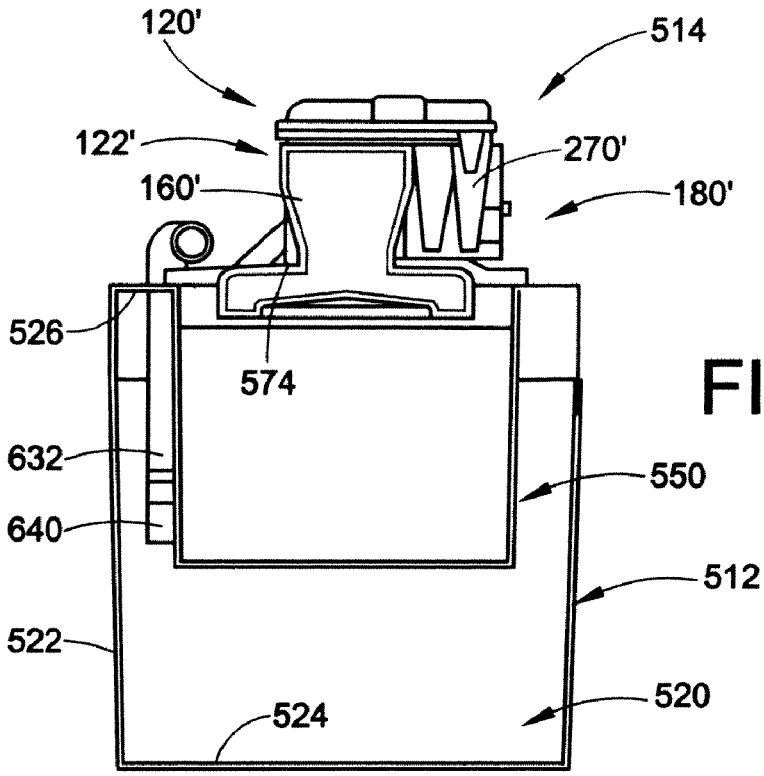
FIG. 13 is a second cross-sectional view of the utility vacuum cleaner of FIG. 10.

With additional reference to FIG. 13, the second cyclone part 180' comprises a plurality of spaced apart, frusto-conical, downstream, second stage cyclonic separators 270'. The downstream separators can be arranged in parallel and can be mounted on the air manifold 232' radially outside of the first cyclone part 122'. Each downstream separator includes a dirty air inlet 274'. The manifold directs a volume of partially cleaned air generally tangentially into the dirty air inlet of each second stage separator 270'. This causes a downward vortex-type, cyclonic or swirling flow.

Contaminants separated by each downstream cyclonic separator 270' are collected in a second, separate particle collector or dust collection container 300' reducing risk of dirt collecting in the area of the particle outlet and causing a blockage. The dust collection container, which is positioned above the receptacle lid 552, can be removably attached to the bottom guide plate 236'. The dust collection container is also removable with the lid 552. With reference to FIGS. 11 and 13, the dust collection container at least partially encases or surrounds the plurality of downstream separators 270'. An opening cover 310 is removably attached to the dust collection container 300'.

As indicated previously, each of the discharge guide tubes 250' directs the cleaned air exhausted from the second cyclone part 180' into the cover unit 240' before being discharged to a filter assembly 320'. As shown in FIGS. 11 and 12, the filter assembly includes a top plenum 322' releasably secured to a bottom plenum 324'. The top plenum collects a flow of cleaned air from the downstream separators 270' and directs the cleaned air through a filter element 330' for filtering any remaining fine dust remaining in the airflow exiting the downstream separators. The bottom plenum collects a flow of cleaned air from the filter element and merges the flow of cleaned air into the inlet of the electric motor and fan assembly 140'. A seal 620 can be provided to create a seal between the bottom plenum and the motor and fan assembly.

Figure 10:
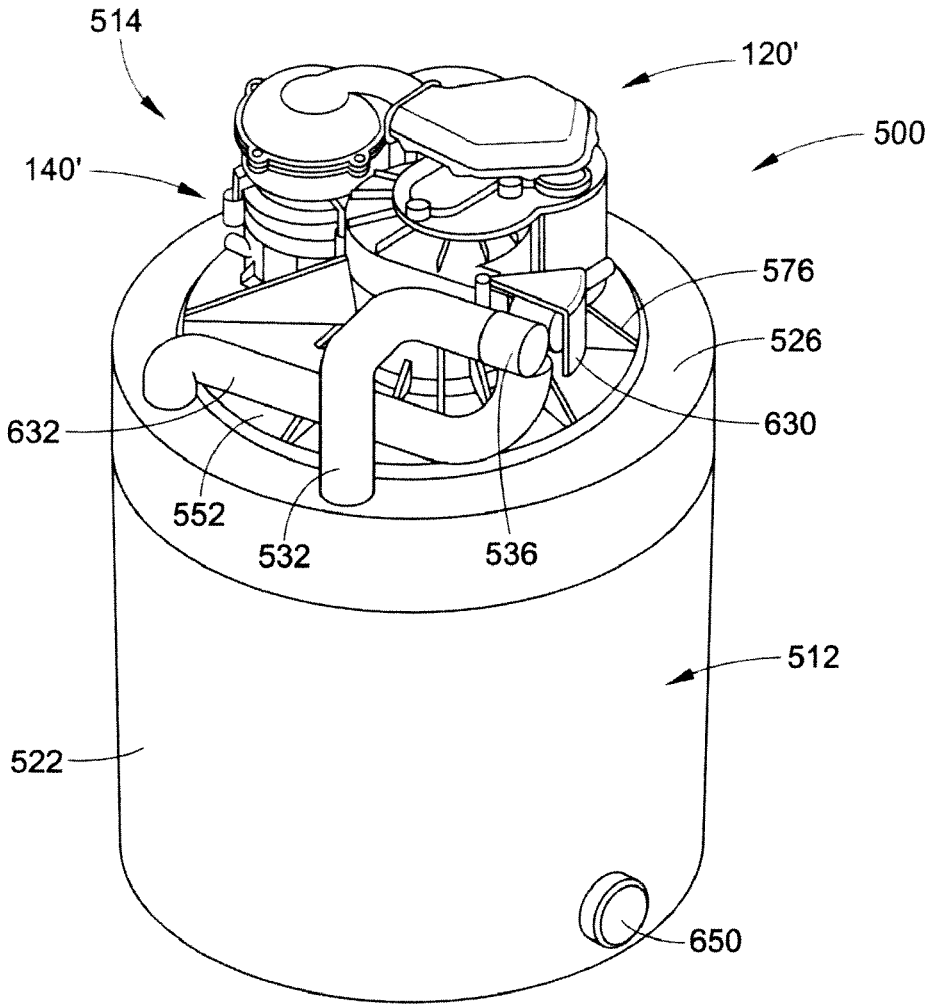
FIG. 10 is a perspective view of a utility vacuum cleaner according to another aspect of the present disclosure.
Figure 14A:
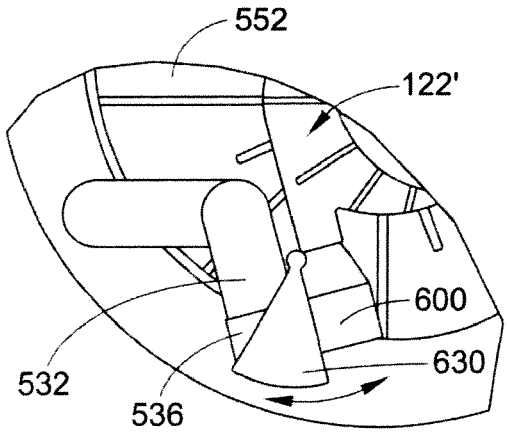
FIGS. 14A and 14B are enlarged partial top plan views of an inlet door of the utility vacuum cleaner of FIG. 10 in a first position and a second position.
Figure 14B:
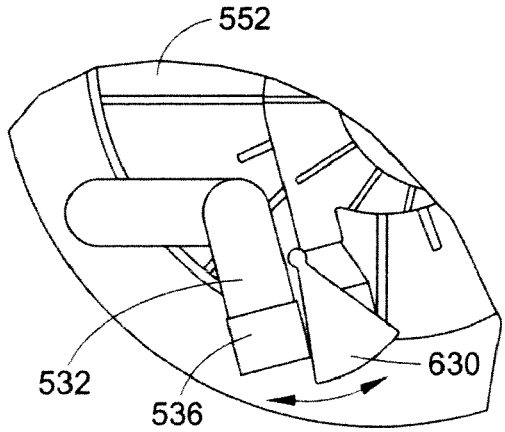

An inlet closing member or inlet door 630 selectively closes one of the duct 600 and the liquid inlet conduit 532 depending on the operation of the cleaner 500. Particularly, in a "wet only" operation, the inlet door 630 (FIG. 14B), which is moveably or hingedly mounted to one of the cleaner body 514 and the lid 552, is positioned over an inlet of the duct 600. This prevents air from flowing directly into the first cyclone part 122'. Dirt, liquid and wetted contaminants flow through the liquid inlet conduit 532 into the chamber 520 of the liquid tank 512. The liquid and wetted contaminants collect on the bottom wall 524 of the liquid tank. As will be described in greater detail below with respect to a "dry only" operation, the dirt entrained air flows out of the chamber 520 via an outlet conduit 632 which at least partially extends through a second opening 634 located on the tank top wall 526. As shown in FIGS. 10 and 11, the outlet conduit 632 includes an inlet section 636 in communication with the chamber 520 and an outlet section 638 in communication with the first cyclone part 122', or with the inlet into the first cyclone separator. A float 640 is provided to block the inlet section 636 when the level of liquid in the chamber reaches a predetermined limit. Accordingly, reverse flow of liquid from the liquid tank 512 is prevented.

In the "dry only" operation, the inlet door 630 (FIG. 14A) is positioned over the inlet section 536 of the liquid inlet conduit 532. The dirt entrained air passes into the upstream, first cyclone separator 160' through the dirty air inlet conduit 162'. The air then travels cyclonically around the separation chamber where many of the particles and liquid entrained in the air are caused, by centrifugal force, to travel along the interior surface of the sidewall of the separator 160' and drop out of the rotating air flow by gravity. These particles collect on the bottom wall 524 of the receptacle 550. The partially cleaned air travels through the perforated tube 184'. The partially cleaned air then travels through the air manifold 232' mounted above the perforated tube and into the frusto-conical downstream cyclonic separators 270' of the second cyclonic stage. There, the air cyclones or spirals down the inner surfaces of the several cyclonic separators to separate out the remaining fine dirt. The now twice cleaned air flows upward through the discharge guide tubes 250' and into the cover unit 240'. Fine dirt separated in the downstream cyclonic separators collects in the dust collection container 300'. The cleaned air flows out of the cover unit into the top plenum 322', through the two stage filter assembly 330' and into the bottom plenum 324'. The bottom plenum is in fluid communication with the air inlet to the electric motor and fan assembly 140'. The cleaned air is discharged to the atmosphere through the exhaust grill 150' of the motor housing 142'.

To empty the liquid tank, a removable plug 650 is located on a lower portion of the wall 522 of the tank and selectively closes an opening 652 therein. Similar to the previous embodiment, the receptacle 550 and the collection container 300' can be emptied independent of each other. This minimizes the amount of fine dust introduced into ambient air during emptying of the receptacle and servicing of the vacuum cleaner. To empty the dirt collected in the receptacle 550, the lid 552 can be detached from the receptacle so that the receptacle can be tilted in order to empty the contents therein. To empty the dirt collected in the collection container 300', the cover 310' is opened so that the container can be emptied, such as by pulling out a drawer holding the dirt. Alternatively, the dirt collected in the container can be transferred into the receptacle 550 for emptying.

It should be appreciated that the vast majority of the debris or dirt will be separated out in the first cyclonic cleaning stage, and collected in the receptacle 550. That is the reason why receptacle is so much larger than the second stage container 300'. Also, the receptacle 550 will likely have to be emptied more frequently than the debris collected in container 300'. It has to be noted that second particle collector can be emptied into receptacle. In this design, the lid 552 serves as a bottom of the second particle collector. A dump door can be utilized to empty second particle collector into first particle collector. The dump door can be actuated by a button or lever.

Figure 15:
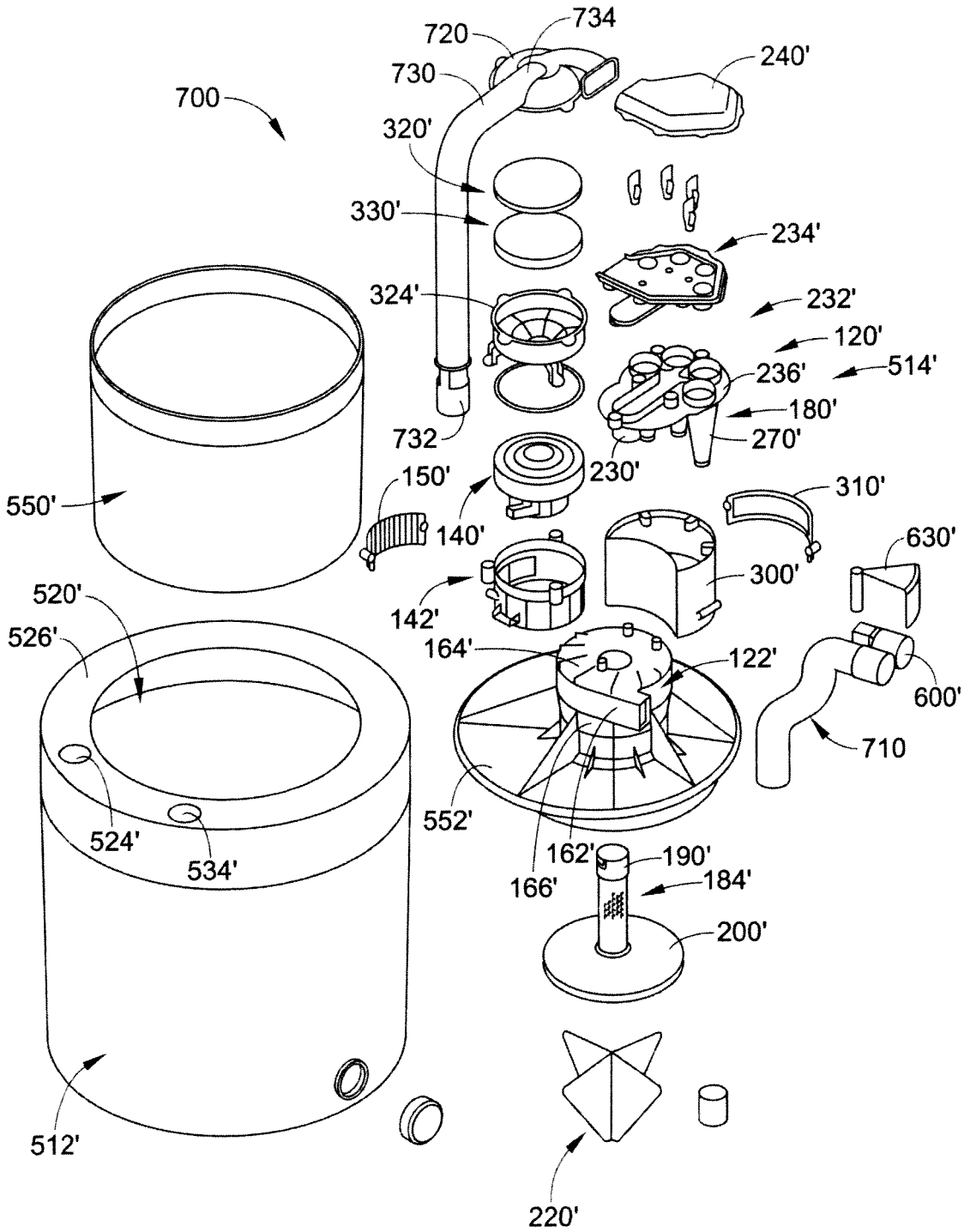
FIGS. 15 and 16 are respective perspective views, taken from different directions, of a utility vacuum cleaner according to yet another aspect of the present disclosure.
Figure 16:
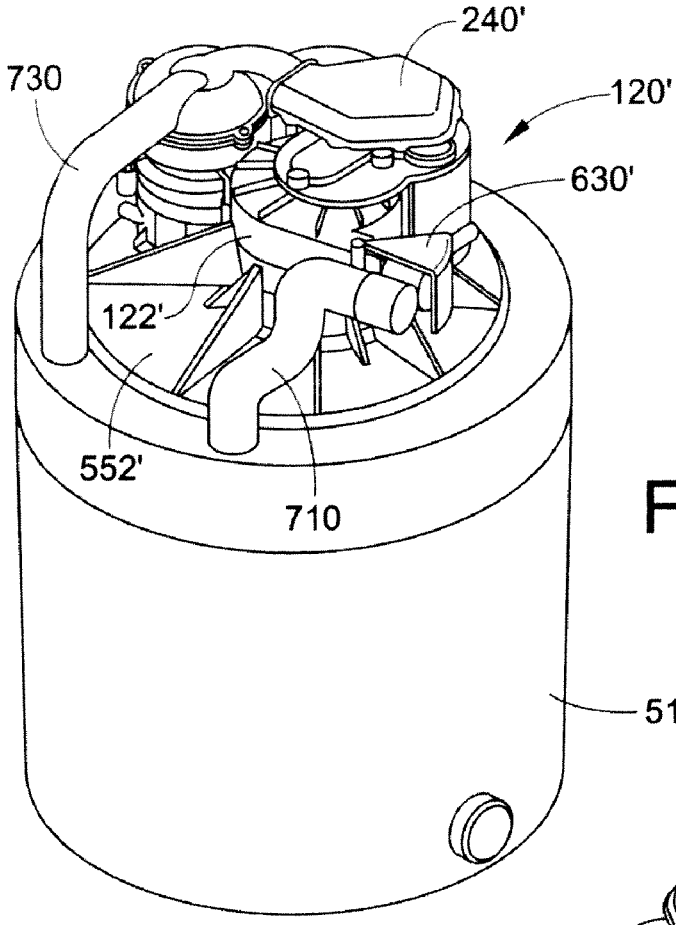
Figure 17:
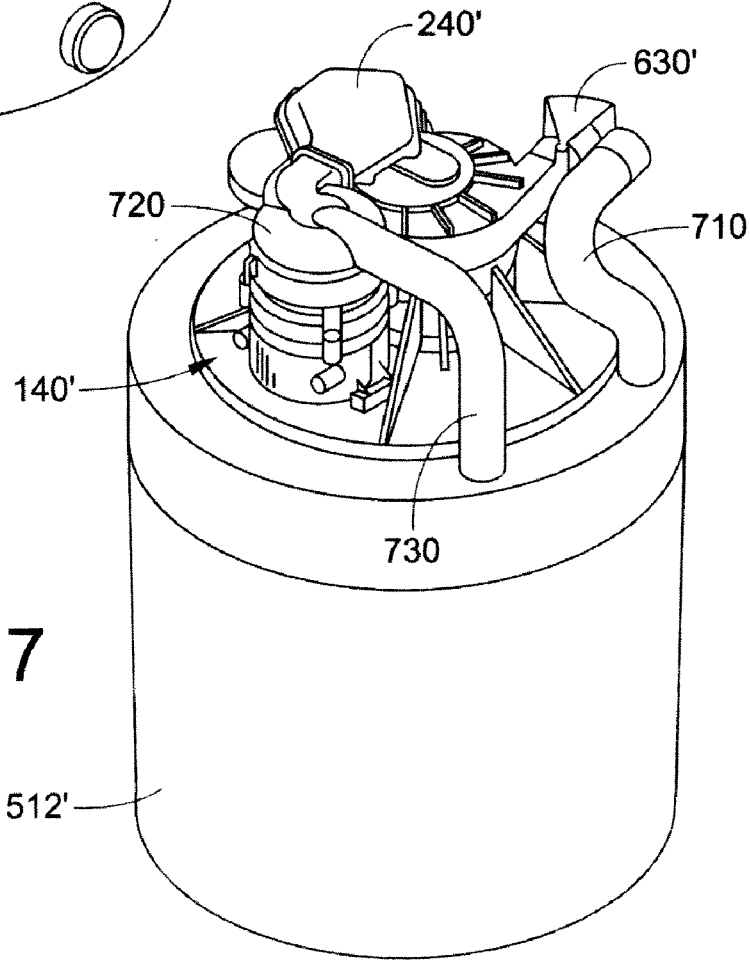
FIG. 17 is an exploded perspective view of the utility vacuum cleaner of FIGS. 15 and 16.

Similar to the second embodiment, a third embodiment of a cyclonic utility vacuum cleaner 700, specifically a wet/dry utility vacuum cleaner, is shown in FIGS. 15-17. Since most of the structure and function is quite similar to the previous embodiments, reference numerals with a primed suffix (') refer to like components (e.g., cyclone assembly 120 is referred to by reference numeral 120'), and new numerals identify new components in the additional embodiment.

With reference to FIGS. 15-17, the cleaner 700 comprises a liquid tank 512' and a cleaner body 514' at least partially housed within a chamber 520' defined by the liquid tank. The cleaner body 514' includes a first particle collector, receptacle or tank 550' for collecting separated contaminants therein. An open upper portion of the receptacle is covered by a removable lid 552'. A cyclone assembly 120' is mounted to the lid and comprises a first cyclone part 122' and a second cyclone part 180' positioned atop the lid. A liquid inlet conduit 710 at least partially extends through a first opening 534' located on a tank top wall 526'.

A suction motor 140', which is housed in a motor housing 142' releasably secured to the lid 552', generates the required suction airflow for cleaning operations by creating a suction force in a suction inlet and an exhaust force in an exhaust outlet. The suction motor exhaust outlet is in fluid communication with an exhaust grill 150', covering an exhaust opening located on a wall of the motor housing 142'.

The first cyclone part 122' can comprise a generally frusto-conical shaped first stage cyclone separator (not visible). The first stage separator includes a dirty air inlet conduit 162', a top wall 164' and a sidewall 166' having an outer surface and an inner surface. The inlet conduit is in fluid communication with a duct 600', which is connected to a suction hose and nozzle (not shown) for suctioning dirt, debris and other contaminants from a surface to be cleaned. Fluidly connecting the first cyclone part to a second cyclone part is a removable perforated tube 184'. Connected to a lower, closed end of the perforated tube is a shroud 200' for retarding an upward flow of dirt and dust particles that have fallen below a lower end of the first stage separator. A laminar flow member 220' can be mounted to the closed lower end of the perforated tube 184'.

An air outlet 190' of the perforated tube 120' is in fluid communication with an air inlet section 230' of an air manifold 232' positioned above the first stage separator. The air manifold includes a top guide plate 234' and a bottom guide plate 236'. The guide plates together direct partially cleaned air flowing from the receptacle 550' and through the perforated tube 184' towards the second cyclone part 180'. The second cyclone part comprises a plurality of spaced apart, frusto-conical, downstream, second stage cyclonic separators 270'. The downstream separators can be arranged in parallel and can be mounted on the air manifold 232' radially outside of the first cyclone part 122'.

A separate dust collection container 300', which is positioned above the receptacle lid 552', collects the dirt separated by each downstream separator 270'. The dust collection container, which at least partially encases or surrounds the plurality of downstream separators 270', includes an opening (not visible) which allows for removal of the dirt particles collected in the container. In the depicted embodiment, an opening cover 310' is removably attached to the sidewall.

The manifold 232' directs the cleaned air exhausted from the second cyclone part 180' into a cover unit 240' before being discharged to a filter assembly 320'. As shown in FIG. 15, the filter assembly includes a top plenum 720 releasably secured to a bottom plenum 324'. An inlet of the top plenum is connected to an outlet of the cover unit 240'. The top plenum collects a flow of cleaned air from the downstream separators 270' and directs the cleaned air through a filter element 330' for filtering any remaining fine dust remaining in the airflow exiting the downstream separators. The bottom plenum collects a flow of cleaned air from the filter element and merges the flow of cleaned air into the inlet of the electric motor and fan assembly 140'.

An inlet door 630' selectively blocks one of an inlet section of the liquid inlet conduit 710 (the "dry only" operation) and an inlet of the duct 600' (the "wet only" operation). As shown in FIGS. 16 and 17, in a "wet only" operation, the inlet door 630', which can be hingedly mounted to the lid 552', is positioned over an inlet of the duct 600'. This prevents air from flowing directly into the first cyclone part 122'. Dirt, liquid and wetted contaminates flow through the liquid inlet conduit 710 into the chamber 520' of the liquid tank 512'. The dirt entrained air flows out of the chamber via an outlet conduit 730 which at least partially extends through a second opening 524' located on the tank top wall 526'. As shown in FIG. 15, the outlet conduit 730 includes an inlet section 732 in communication with the chamber 520' and an outlet section 734 in direct communication with the upper plenum 720. In other words, in this embodiment, the cyclonic separation stages are not employed in the "wet only" configuration. Rather, the air from the chamber 520' flows directly to the filter assembly 320'.

Figure 18:
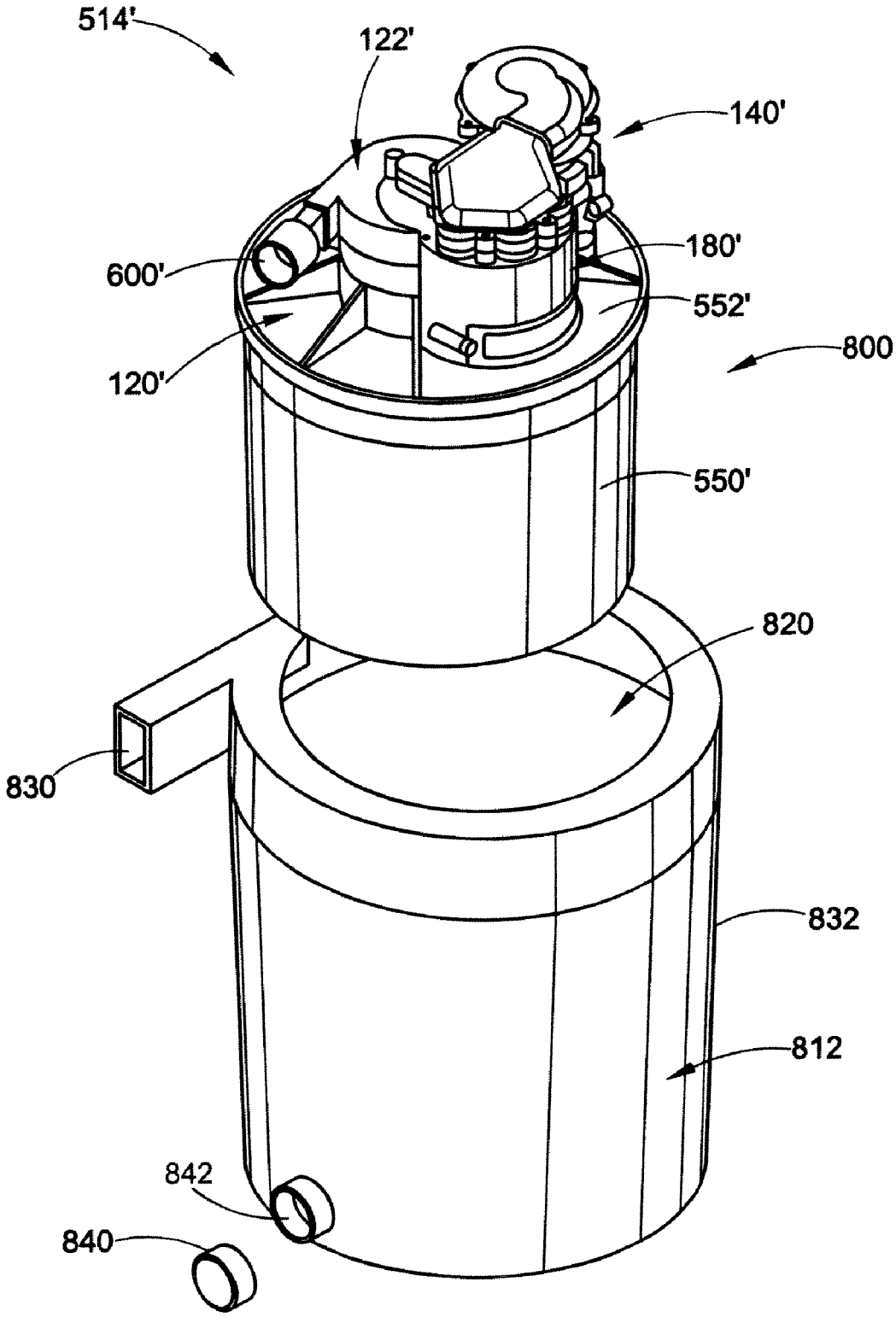
FIG. 18 is an exploded perspective view of a utility vacuum cleaner according to yet another aspect of the present disclosure.

Similar to the second and third embodiments, a fourth embodiment of a cyclonic utility vacuum cleaner 800, specifically a wet/dry utility vacuum cleaner, is shown in FIG. 18. Since most of the structure and function is quite similar to the previous embodiments, reference numerals with a primed suffix (') refer to like components (e.g., cyclone assembly 120 is referred to by reference numeral 120'), and new numerals identify new components in the additional embodiment.

Figure 19:
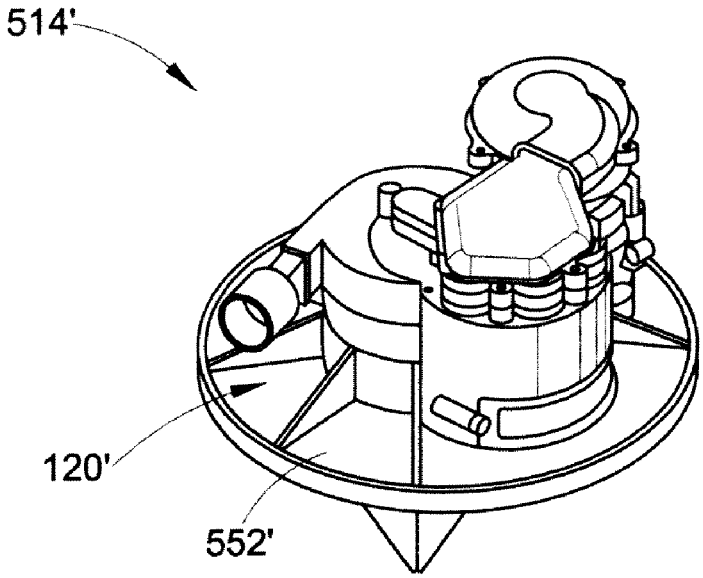
FIG. 19 is an exploded perspective view of a utility vacuum cleaner according to yet another aspect of the present disclosure.
Figure 19:
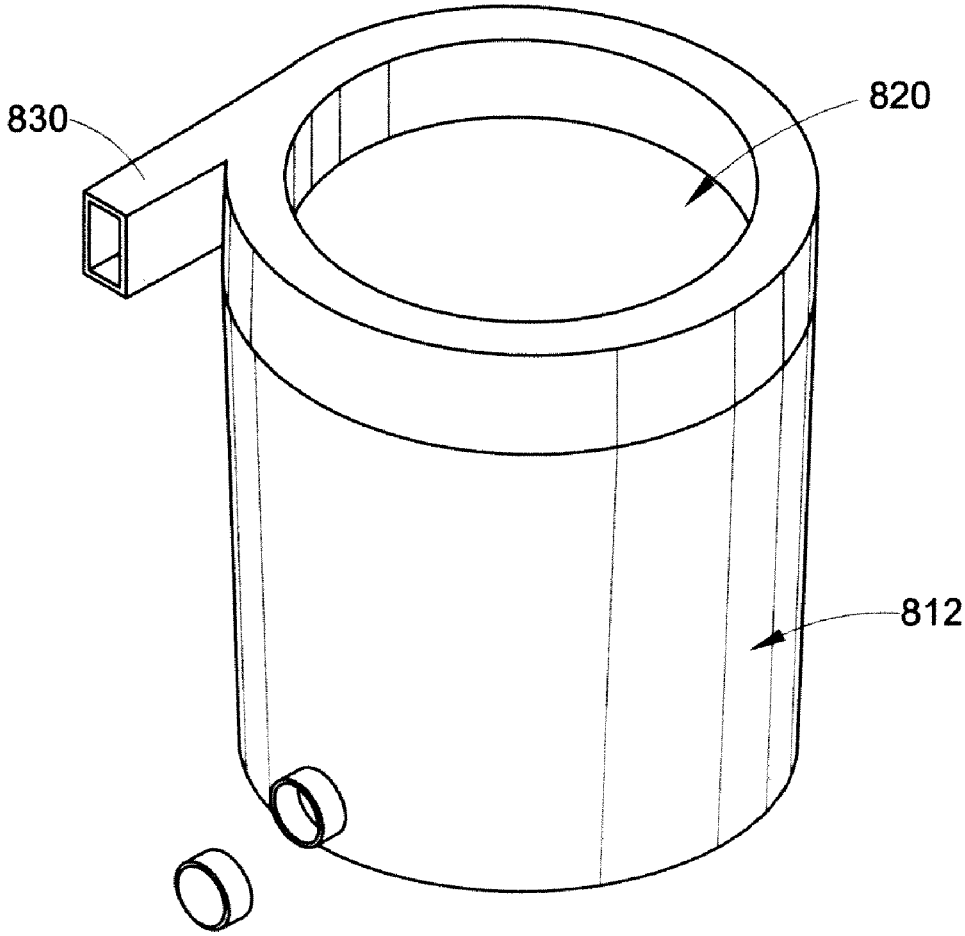

With reference to FIG. 18, the cleaner 800 comprises a liquid tank 812 and a cleaner body 514' at least partially housed within a chamber 820 defined by the liquid tank. A liquid inlet conduit 830 is located on a top portion of a wall 832 of the liquid tank 812. The cleaner body 514' can include a first particle collector, receptacle or tank 550' for collecting separated contaminants therein. An open upper portion of the receptacle is covered by a removable lid 552'. Alternatively, as shown in FIG. 19, a separate tank is not used for collecting separated contaminants. Instead, the contaminants are collected in the liquid tank 812 and the lid 552' is dimensioned to cover an open upper portion of the liquid tank.

A cyclone assembly 120' is mounted to the lid and comprises a first cyclone part 122' and a second cyclone part 180' positioned atop the lid. A suction motor 140', which is releasably secured to the lid 552', generates the required suction airflow for cleaning operations by creating a suction force in a suction inlet and an exhaust force in an exhaust outlet.

An inlet door 630' selectively blocks one of an inlet section of the liquid inlet conduit 710 (the "dry only" operation) and an inlet of the (the "wet only" operation). In a "wet only" operation, dirt, liquid and wetted contaminates flow through the liquid inlet conduit 830 into the chamber 820 of the liquid tank 812. To empty the liquid tank, a removable plug 840 is located on a lower portion of the wall 832 of the tank and selectively closes an opening 842 therein. In a "dry only" operation, dirt entrained air flows through the duct 600' into the cyclone assembly 120'. In this embodiment, the cyclonic separation stages are not employed in the "wet only" configuration.

As to a further discussion of the manner of usage and operation of the cleaners 700, 800 and 900, the same should be apparent from the above description relative to the first and second embodiments. Accordingly, no further discussion relating to the manner of usage and operation will be provided.

Several embodiments of a cyclonic utility vacuum cleaner have been described herein. Obviously, modifications and alterations will occur to others upon reading and understanding the preceding detailed description. It is intended that the illustrated embodiments be construed as including all such modifications and alterations, insofar as they come within the scope of the appended claims or the equivalents thereof.

What is claimed is:

1. A vacuum cleaner including multiple cleaning stages, comprising:

a first cyclonic stage;

a housing defining a first particle collector communicating with the first cyclonic stage, the first particle collector including an opening;

a removable lid for covering the first particle collector opening;

a second cyclonic stage, spaced from the first cyclonic stage;

a second particle collector in communication with the second cyclonic stage, wherein the second particle collector is removable from the first particle collector with the lid; and a suction motor supported by the vacuum cleaner, the suction motor establishing and maintaining a flow of air through the vacuum cleaner.

2. The vacuum cleaner of claim 1, wherein at least a portion of the first cyclonic stage is mounted to the removable lid such that the portion first cyclonic stage is removable from the first particle collector with the lid.

3. The vacuum cleaner of claim 2, wherein at least a portion of the second cyclonic stage is mounted to the lid such that the portion of the second cyclonic stage is removable from the first particle collector with the lid.

4. The vacuum cleaner of claim 1, wherein the first and second particle collectors are configured to empty independently of each other.

5. The vacuum cleaner of claim 1, wherein the first cyclonic stage includes an upstream cyclonic separator for separating dust from dust-laden air and, wherein the second cyclonic stage includes a plurality of downstream cyclonic separators for separating remaining dust particles from air which has been partially cleaned by the first cyclone separator.

6. The vacuum cleaner of claim 5, further comprising a perforated tube extending along a longitudinal axis of the first cyclonic separator.

7. The vacuum cleaner of claim 1, further comprising a filtration stage located downstream from the first and second cyclonic stages and upstream of the suction motor.

8. The vacuum cleaner of claim 1, further comprising an outer tank which supports the housing, wherein the outer tank can accommodate a liquid and includes a drain port for the liquid.

9. A dual stage cyclonic utility vacuum cleaner comprising:

a first particle collector for collecting separated contaminants therein, the first particle collector including an upper opening;

a removable lid for covering the first particle collector opening;

a cyclone assembly mounted to the lid, the cyclone assembly including a first, upstream, cyclone stage in communication with the first particle collector and a second, downstream, cyclone stage;

a second particle collector in communication with the second cyclone stage wherein the cyclone assembly is removable from the first particle collector with the lid; and a suction motor supported by the utility vacuum cleaner for establishing and maintaining a flow of air through the utility vacuum cleaner.

10. The utility vacuum cleaner of claim 9, further comprising a first inlet conduit in communication with the first particle collector and a second inlet conduit in communication with the cyclone assembly.

11. The utility vacuum cleaner of claim 10, further comprising an inlet door for selectively closing one of the first inlet conduit and the second inlet conduit.

12. The utility vacuum cleaner of claim 9, wherein the first and second particle collectors are configured to empty independently of each other.

13. The utility vacuum cleaner of claim 9, wherein the second cyclone stage includes a plurality of downstream cyclonic separators for separating remaining dust particles from air which has been partially cleaned by the first cyclone stage.

14. The utility vacuum cleaner of claim 9, further comprising:

a perforated tube supported by the lid and extending along a longitudinal axis of the first cyclone stage, and an air manifold disposed outside the first particle collector, the perforated tube and the air manifold fluidly connecting the first cyclone stage to second cyclone stage.

15. The utility vacuum cleaner of claim 9, further comprising a filtration stage located downstream from the cyclone assembly and upstream of the suction motor, wherein the filtration stage includes a plenum defining an enclosure for housing a filter therein.

16. The utility vacuum cleaner of claim 9, wherein at least a part of the cyclone assembly forms an exterior surface of the utility vacuum cleaner.

17. A vacuum cleaner including multiple cleaning stages, comprising:

a housing defining a particle collector, the particle collector including an opening;

a removable lid for covering the particle collector opening, the removable lid including one of a cylindrical and frusto-conical external wall;

a cyclonic stage communicating with the particle collector, wherein the external wall of the removable lid at least partially defines the cyclonic stage; and a suction motor supported by the housing, the suction motor establishing and maintaining a flow of air through the vacuum cleaner.

18. The vacuum cleaner of claim 17, wherein the external wall of the removable lid completely defines the cyclonic stage.

19. The vacuum cleaner of claim 17, further comprising a filtration stage located downstream from the cyclonic stage, wherein the filtration stage is supported by and removable with the lid.

20. The vacuum cleaner of claim 19, wherein the filtration stage is supported on an outer surface of the removable lid.

* * * * *